US005144340A

United States Patent [19]

Hotomi et al.

[11] Patent Number: 5,144,340

[45] Date of Patent: Sep. 1, 1992

[54] INKJET PRINTER WITH AN ELECTRIC CURTAIN FORCE

[75] Inventors: Hideo Hotomi; Hisashi Myochin, both of Osaka, Japan

[73] Assignee: Minolta Camera Kabushiki Kaisha, Osaka, Japan

[21] Appl. No.: 746,801

[22] Filed: Aug. 14, 1991

Related U.S. Application Data

[63] Continuation of Ser. No. 490,329, Mar. 8, 1990, abandoned.

[30] Foreign Application Priority Data

Mar. 10, 1989 [JP] Japan ..... 1-58194
May 9, 1989 [JP] Japan ..... 1-115853

[51] Int. Cl.[5] ..... B41J 2/01; B41J 2/06
[52] U.S. Cl. ..... 346/140 R
[58] Field of Search ..... 346/140 R, 75

[56] References Cited

U.S. PATENT DOCUMENTS 3,809,980 5/1974 Nottingham ..... 363/154
4,364,054 12/1982 Kelly ..... 346/1.1
4,618,809 10/1986 Maeda ..... 363/154
4,717,926 1/1988 Hotomi ..... 346/140 R
4,943,818 7/1990 Hotomi ..... 346/140 R
4,962,723 10/1990 Hotomi ..... 118/654

*Primary Examiner*—Benjamin R. Fuller
*Assistant Examiner*—Alrick Bobb
*Attorney, Agent, or Firm*—Burns, Doane, Swecker & Mathis

[57] ABSTRACT

An inkjet printer which comprises a nozzle having an exit opening; an electric field curtain forming unit for causing an electric field curtain force or a travelling-wave electric field curtain to act on inking material located in the vicinity of the exit opening of the nozzle; a charge injecting unit disposed in the vicinity of the exit opening of the nozzle for injecting an electric charge into the inking material; and an image control unit operable in response to image information to control the charge injecting unit to vary the amount of electric charge to be injected into the inking material. The inking material located in the vicinity of the nozzle can be expelled outwardly from the nozzle by the action of the electric field curtain force in a quantity dependent on the amount of the electric charge injected by the charge injecting unit.

22 Claims, 14 Drawing Sheets

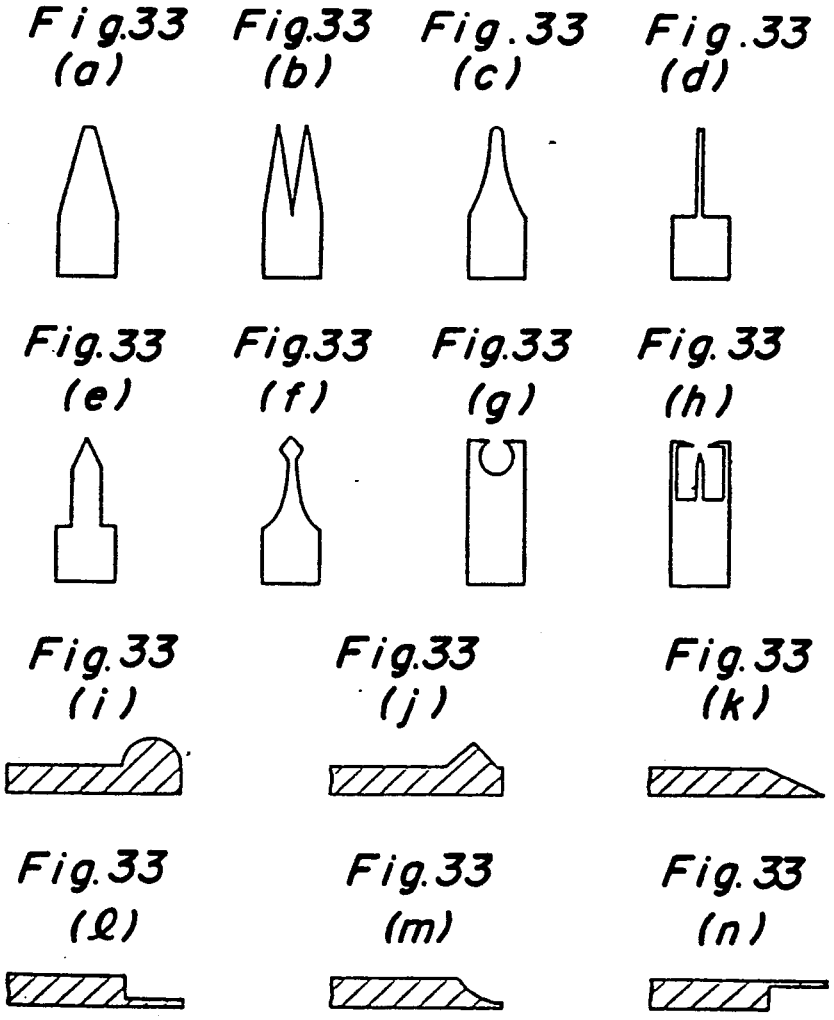
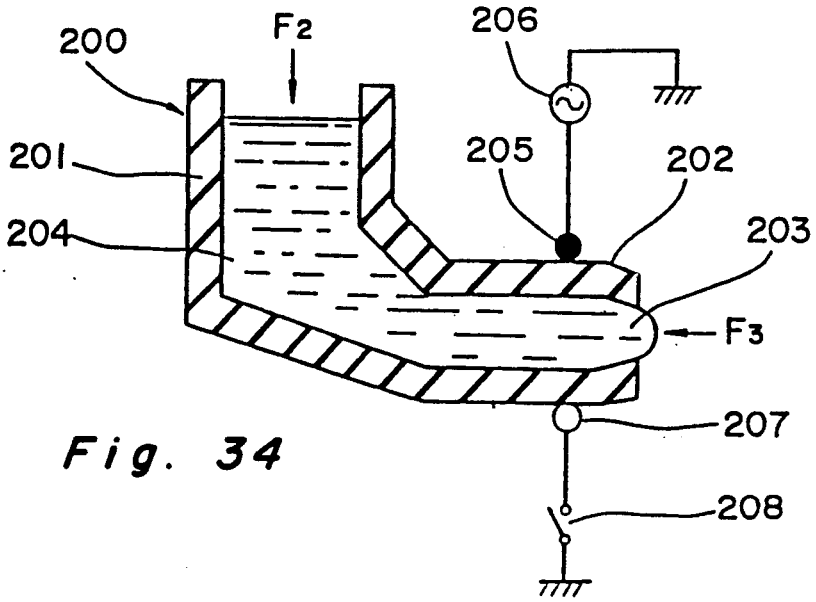
Fig. 34

INKJET PRINTER WITH AN ELECTRIC CURTAIN FORCE

This application is a continuation of application Ser. No. 07/490,329, filed Mar. 8, 1990 now abandoned.

BACKGROUND OF THE INVENTION

1. Field of the Invention

The present invention generally relates to an inkjet printer and, more particularly, the inkjet printer of a type utilizing a curtain of electric field for expelling droplets of inking material towards a recording medium.

2. Description of the Related Art

U.S. Pat. No. 4,717,926, issued Jan. 5, 1988, to Hideo Hotomi, one of the inventors of the present invention, and assigned to the same assignee of the present invention, discloses the inkjet printer utilizing a curtain of electric field (hereinafter referred to as an electric field curtain) for successively expelling droplets of fluidic inking material from a nozzle towards a recording medium. For the purpose of discussion of the principle of operation of the inkjet printer of the type disclosed therein, FIGS. 34 and 35 of the accompanying drawings illustrates, in schematic longitudinal sectional representation, a printer head used in such inkjet printer.

Referring to FIGS. 34 and 35, the printer head, generally identified by 200, comprises a ink reservoir 201 made of electrically insulating material and having a nozzle 202. The nozzle 202 has one end communicated with the bottom of the ink reservoir 201 and the opposite end formed with, or otherwise shaped to provide, an orifice 203. The ink reservoir 201 accommodates therein a quantity of fluidic inking material 204 which may be either a high resistance ink containing electrically charged coloring particles or an electrically chargeable ink. The nozzle 202 has first and second electrodes 205 and 207 disposed exteriorly therearound in the vicinity of the orifice 203 and spaced 180° circumferentially with respect to the longitudinal axis of the nozzle 202. The first electrode 205 is electrically connected with an alternating current source while the second electrode 207 is grounded through a switch 208.

In the illustrated printer head disclosed in the above mentioned U.S. patent, so long as the switch 208 is open as shown in FIG. 24, a force $F_2$ tending to expel the inking material 204 outwardly from the orifice 203 in the nozzle 202 and a force $F_3$ of surface tension tending to drag the inking material 204 inwardly of the nozzle 202 against the force $F_2$ act on portion of the inking material 204 retained within an exit area of the nozzle 202 adjacent the orifice 203 and encompassed by the first and second electrodes 205 and 207. If these forces $F_2$ and $F_3$ are in equilibrium with each other, that portion of the inking material 204 will not be expelled outwardly from the orifice 203.

However, upon closure of the switch 208 as a result of application thereto of an image signal supplied from a memory unit 209 through a control unit 210 as shown in FIG. 35, a force $F_1$ induced by the electric field curtain (hereinafter referred to as an electric field curtain force) is developed in the electrically charged particles contained in the inking material 204 and, therefore, that portion of the inking material 204 within the exit area of the nozzle 202 adjacent the orifice 203 and encompassed by the first and second electrodes 205 and 207 is expelled outwardly from the orifice 203 towards a recording medium 211 in the form of an ink droplet 204*a* which is subsequently deposited on the recording medium 211. The electric field curtain force referred to above stands for a Coulomb force imposed on the electrically charged material by an alternating electric field which is unequal in time and space.

Thus, the inkjet printer disclosed in the above mentioned U.S. patent is so designed and so structured that, when an alternating voltage is applied to the first and second electrodes 205 and 207 in the printer head 200 in response to the image signal to form the electric field curtain, the inking material 204 can be expelled outwardly from the nozzle 202 in the form of ink droplets by the action of the electric field curtain so developed.

Accordingly, the inkjet printer utilizing the electric field curtain as described above is advantageous in that, as compared with well-known printers employing a stem system in which a piezoelectric element is utilized within the ink reservoir to apply to the inking material within the ink reservoir a pressure necessary to expel the inking material outwardly from the nozzle, a Caizer system and a pulse jet system, a relatively large change in volume can be available for a small work surface area and, therefore, the apparatus as a whole can be manufactured compact.

However, while a space 212 left within the nozzle 202 in the vicinity of the orifice 203 as a result of the ink droplet 204*a* having been expelled outwardly from the orifice 203 is required to be replenished by the remaining inking material 204 within the nozzle 202, the illustrated printer head 200 is not provided with a positive delivery means for positively delivering the remaining portion of the inking material 204 towards the orifice 203 to fill up the space 212 and, therefore, a relatively long time is required to fill up the space 212 with the remaining portion of the inking material 204. The time required to fill up the space 212 with the remaining portion of the inking material 204 may be more or less reduced if the switching frequency response is increased, however, the increase of the switching frequency response is limited.

The force necessary to expel the inking material 204 outwardly from the orifice 203 depends solely on the force induced by the electric field curtain developed between the first and second electrodes 205 and 207 and, therefore, a relatively high voltage has to be applied to the electrodes 205 and 207 in order for that portion of the inking material in a static state to be expelled outwardly from the orifice 203. This renders it difficult to employ a relatively low voltage for the inking material to be expelled outwardly, the employment of the relatively high voltage for this purpose resulting in the production of relatively large ink droplets which are attributable to the recording medium bearing relatively large dots with reduction in tone. Also, since an integrated circuit in a driver for each dot requires a relatively high voltage, rendering the inkjet printer as a whole to be costly.

SUMMARY OF THE INVENTION

The present invention has been devised with a view to substantially eliminating the above discussed problems inherent in the inkjet printer of the type discussed above and has for its object to provide an improved inkjet printer utilizing the electric field curtain force, which is very compact in size.

Another important object of the present invention is to provide an improved inkjet printer of the type referred to above, which can exhibit a high response in image formation and a high tone reproducibility.

A further important object of the present invention is to provide an improved inkjet printer of the type referred to above, which is very inexpensive to manufacture.

In one aspect, the foregoing and other objects of the present invention can be accomplished by providing an inkjet printer which comprises a nozzle having an exit opening; an electric field curtain forming means for causing an electric field curtain force to act on inking material located in the vicinity of the exit opening of the nozzle; a charge injecting means disposed in the vicinity of the exit opening of the nozzle for injecting an electric charge into the inking material, located in the vicinity of the exit opening of the nozzle; and an image control means operable in response to image information to control the charge injecting means to vary the amount of electric charge to be injected into the inking material, whereby the inking material located in the vicinity of the nozzle can be expelled outwardly from the nozzle by the action of the electric field curtain force in a quantity dependent on the amount of the electric charge injected by the charge injecting means.

In a different aspect, the foregoing and other objects of the present invention can be accomplished by providing an inkjet printer which comprises a nozzle having an exit opening; a travelling-wave electric field curtain forming means for causing a travelling-wave electric field curtain force, developed in a direction facing the exit opening of the nozzle, to act on inking material located in the vicinity of the exit opening of the nozzle; a charge injecting means disposed in the vicinity of the exit opening of the nozzle for injecting an electric charge into the inking material, located in the vicinity of the exit opening of the nozzle; and an image control means operable in response to image information to control the charge injecting means to vary the amount of electric charge to be injected into the inking material, whereby the inking material located in the vicinity of the nozzle can be expelled outwardly from the nozzle by the action of the electric field curtain force in a quantity dependent on the amount of the electric charge injected by the charge injecting means.

BRIEF DESCRIPTION OF THE DRAWINGS

These and other objects and features of the present invention will become clear from the following description taken in conjunction with preferred embodiments thereof with reference to the accompanying drawings, in which:

FIGS. 33(*a*) to 33(*n*) are top plan view of electrodes; and

FIGS. 34 and 35 are schematic longitudinal sectional views of the conventional printer head in different operative positions, respectively.

DETAILED DESCRIPTION OF THE EMBODIMENT

Principle of the Invention

The principle of the present invention will first be described with reference to FIGS. 1 and 2.

Figure 1:
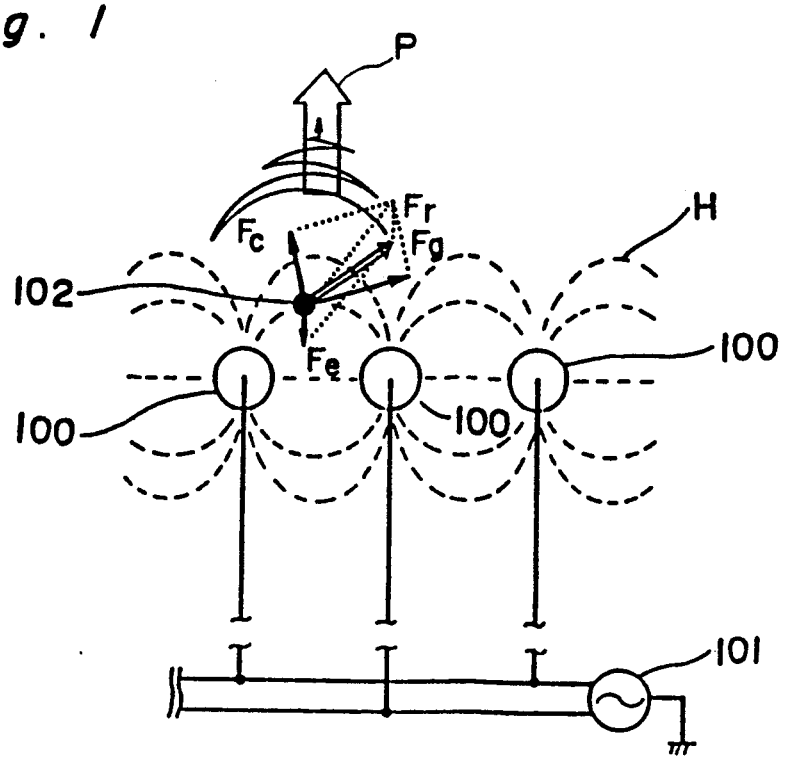
FIG. 1 is a schematic diagram showing how an electric field curtain is developed.

Referring first to FIG. 1, if two electrodes generally identified by 100 are connected to an alternating power source 101, an alternating electric field is developed between the electrodes 100 and in the vicinity thereof as indicated by H and, therefore, all of three forces, i.e., a gradient force Fg parallel to the gradient of the electric field, a centrifugal force Fc acting perpendicular to the gradient force Fg in a direction away from the common plane passing through the electrodes 100, a centrifugal force Fc acting in a direction away from an external plane and an external force Fe (such as resulting from the gravitational force and/or the force induced by a wind blow) act at a certain moment on an electrically charged particle 102 situated between the electrodes 100. Assuming that the external force Fe is small, the cumulative force Fr equal to the sum of the gradient and centrifugal forces Fg and Fc acts in such a direction that the electrically charged particle 102 may be expelled away from the electrodes 100.

Since the direction of the lines of electric force varies with the applied alternating voltage, the electrically charged particle 100 undergo a generally zig-zag motion in dependence on the frequency of the alternating voltage and is finally expelled in a direction shown by the arrow P under the influence of Coulomb force of repulsion (which force is called the electric field curtain force). The magnitude of the electric field curtain force is related with the amount of electric charge born by the electrically charged particle 102.

Applying the foregoing theory to the fluidic inking material, it will readily be understood that, if the amount of electric charge on the electrically charged particle 102 is relatively large, that is, that portion of the inking material which is exposed to an area where the electric charge is highly concentrated, that portion of the inking material will be expelled into the air. Conversely, if the amount of electric charge on the electrically charged particle 102 is relatively small, that portion of the inking material exposed to the charge concentrated area will not be expelled into the air because the surface tension is higher than the electric field curtain force.

Figure 2:
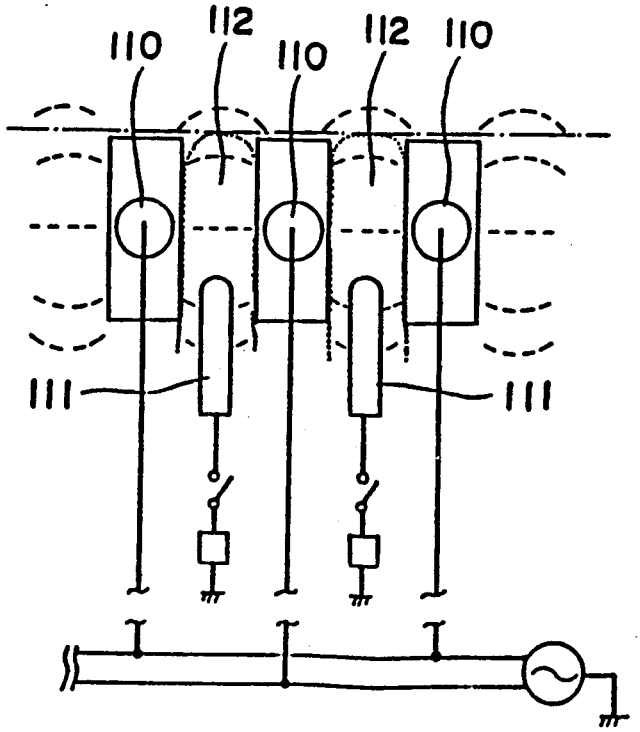
FIG. 2 is a fragmentary sectional view showing the principle of the present invention.

Accordingly, as shown in FIG. 2, if charge injecting electrodes 111 are positioned each between the neighboring electrodes 110 used to develop the electric field curtain so that an electric charge can be injected into an electrically charged fluid with liquid state then placed in a condition in which the electric field curtain force and the surface tension are in equilibrium with each other, the electrically charged fluid situated at the area 112 where the electric charge is injected by the associated charge injecting electrode 111 will receives an increased electric field curtain force of a magnitude enough to destroy the equilibrium with the surface tension and, therefore, such electrically charged fluid can be expelled to the air.

The printer head herein disclosed in accordance with the present invention operates on the foregoing principle and, hereinafter, numerous preferred embodiments of such printer head according to the present invention will be described.

Figure 3:
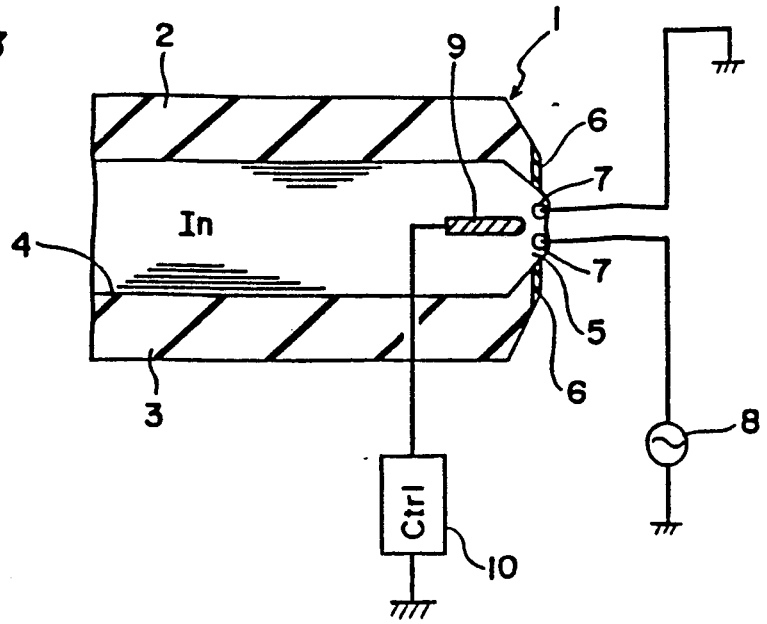
FIG. 3 is a schematic longitudinal sectional view of a printer head according to a first preferred embodiment of the present invention.

First Embodiment (FIG. 3)

FIG. 3 illustrates, in schematic longitudinal sectional representation, a printer head used in a recording apparatus according to a first preferred embodiment of the present invention. The printer head is generally identified by 1 and comprises a nozzle casing including upper and lower panel members 2 and 3 of electrically insulating material positioned one above the other so as to define a nozzle 4 that extends continuously in a direction perpendicular to the plane of the drawing of FIG. 3. The nozzle casing including the upper and lower panel members 2 and 3 is open at 5 so as to define a slit-shaped orifice between respective side faces of the upper and lower panel members 2 and 3, said side faces of the upper and lower panel members 2 and 3 being lined at 6 with an electrically insulating material having no affinity with inking material used. Within the orifice 5, there is disposed two wire electrodes 7 which extend parallel to each other and are connected with an alternating power source 8. A plurality of charge injecting electrodes 9 each having one end electrically connected with an individual driver IC 10 through a suitable wiring are accommodated within the nozzle 4 in equally spaced relationship with each other and are supported in position with the opposite end of each charge injecting electrode 9 situated intermediate between the wire electrodes 7. Although not shown, the nozzle 4 is supplied with inking solution In from a suitable reservoir communicated therewith.

The upper and lower panel members 2 and 3 forming the nozzle casing is preferably made of material having an affinity with the inking solution In to such an extent that the inking solution In can seep towards the orifice 5 by a capillary action. Specifically, at least respective inner surfaces of the upper and lower panel members 2 and 3 which contact the inking solution In within the nozzle 4 are preferably formed with, or otherwise lined with, material having the affinity with the inking solution In. In other words, where the inking solution In is oil-based, the material for the nozzle is preferred to have an affinity to oil. An example of this type of material for the nozzle 4 includes one or a mixture of thermoplastic resins such as, for example, polyester resin, polyamide resin, acrylic resin, polycarbonate resin, polyimide resin, ethylene-vinyl acetate copolymer, styrene-butadiene copolymer, vinyl chrolide acetate copolymer, and cellulose ester; one or a mixture of photosetting resins such as, for example, poly-N-vinylcarbazole, polyvinyl pyrene and polyvinyl anthracene; a liquid crystal polymer; a mixture with the liquid crystal polymer; or a mixture of two or more of these materials. In employing a resin out from these compounds, the compound should be preferred to have a volume resistance not lower than $1.0\times10^{13}\Omega$.

On the other hand, where the inking solution In has a hydrophilic property, an example of this type of material for the nozzle 4 includes inorganic material such as, for example, ceramics such as silica glass. Alternatively, any one of the foregoing resins mixed with about 10 to 60 wt % of an additive such as, for example, glass fibers, tinanium oxide or TISMO (potassium titanate) for imparting a hydrophilic property to such resin may also be employed for the material for the nozzle 4. Advantageously, the addition of the glass fibers or tinanium oxide is effective to increase the toughness of the nozzle and also to facilitate the precise manufacture of the nozzle to close tolerance.

The nature of the alternating power source 8 used to form the electric field curtain in the practice of the present invention will now be discussed.

In the embodiment of the present invention now under discussion, the alternating power source 8 is employed of a type capable of providing an output having a frequency of 3 KHz and a peak-to-peak voltage Vp-p of 200 volts. However, the present invention may not be limited to the use of such specific type of alternating power source and may employ any suitable alternating power source capable of providing the output of sine wave, rectangular wave or sawtooth wave. Although the output from the alternating power source 8 and the frequency thereof may depend largely on the physical property of the inking solution used and the shape of the nozzle, the use of the alternating power source 8 is preferred of a type capable of generating an output of a peak-to-peak voltage Vp-p within the range of 50 to 2,000 volts, preferably 50 to 1,000 volts, and of a frequency f within the range of 50 to 10,000 Hz, preferably 100 to 5,000 Hz.

With respect to the electrically insulating lining 6 having no affinity with the inking solution In used, the provision of the insulating lining 6 is required to render the respective side faces of the upper and lower panel members 2 and 3 exteriorly of the slit-shaped orifice 5, that is, the tip of the nozzle 4, to have no affinity with the inking solution In. However, the insulating lining 6 may not be always essential in the practice of the present invention. Where the insulating lining 6 is employed as shown and discussed above, the insulating lining 6 may be made of hydrophobic material if the inking solution In used is hydrophilic, or hydrophilic material if the inking solution In used is hydrophobic.

While the details of the inking solution In used in the practice of the present invention will be discussed later, the inking solution In should essentially be of a type capable of being electrically charged by any suitable means. For this purpose, the inking solution In should be of a high resistance type containing electrically charged particles dispersed therein or of a type capable of electrically charged. In particular, the inking solution capable of electrically charged means any inking solution which can be electrically charged as a result of injection of electric charge such as electrons or hole ions from the charge injecting electrodes, of induction charging within an electrostatic field, of contact with the surrounding wall and/or the electrodes, of polarization occurring in the inking solution or of the presence of a polar group in the inking solution.

While the printer head 1 is so constructed as hereinbefore described, it operates in the following manner. The inking solution In within the nozzle 4 flows by the capillary action within the nozzle 4 while somewhat electrically charged as a result of its contact with the surrounding inner surface of the nozzle 4.

When the alternating voltage from the alternating power source 8 is applied to the wire electrodes 7, an electric field curtain can be developed between the wire electrodes 7 and in the vicinity thereof.

Consequent upon the formation of the electric field curtain, the inking solution In present in the vicinity of the orifice 5 and electrically charged as a result of contact with the nozzle 4 are affected by the electric field curtain because of a triggering action brought about by the electric charge built up in the inking solution In upon contact with the nozzle 4. The portion of the inking solution In situated within the nozzle 4 inwardly from the wire electrodes 7 then receives a force acting inwardly of the nozzle 4 while another portion of the inking solution In situated within the nozzle 4 outwardly from the wire electrodes 7 receives a force acting in a direction outwardly of the nozzle 4. However, the force acting in the direction outwardly of the wire electrodes 7 is counterbalanced with the surface tension and, therefore, a portion of the inking solution In situated within the orifice 5 will be neither dropped nor expelled outwardly from the nozzle 4 through the orifice 5 and will be retained in the orifice 5.

Starting from this condition, and when signals are supplied to the individual charge injecting electrodes 9 in correspondence with image information, an electric charge is injected from the charge injecting electrodes 9 into portion of the inking solution In situated between the wire electrodes 7 and at a location outwardly therefrom and, consequently, the electric field curtain force acting on that portion of the inking solution In situated between the wire electrodes 7 is increased. When this electric field curtain force increases to such an extent as to overcome the surface tension by charge injecting from the electrodes 9, that portion of the inking solution In situated at an area encompassed by the wire electrodes 7 within the nozzle 4 is expelled outwardly from the nozzle 4 through the orifice 5 and towards a recording medium (not shown) such as, for example, a web of paper.

When the charge injection is interrupted and the charge injecting electrodes 9 are electrically grounded, the electric charge once built up in that portion of the inking solution In within the area encompassed by the wire electrodes 7 is erased and consequently flows towards the orifice 5 to fill up a space left there by that portion of the inking solution which has been expelled outwardly from the nozzle 4 through the orifice 5. The inking solution In flowing towards the orifice 5 to fill up the space referred to above is electrically charged again in contact with the surrounding inner wall surface of the nozzle 4.

While in the following description some other preferred embodiments of the present invention are individually set forth, the foregoing description made in connection with the type of material used to form the nozzle, the output characteristics, including voltage and frequency, of the power source used to form the electric field curtain, and the provision of the hydrophobic lining at the tip of the nozzle is to be understood as all applicable to each of those other preferred embodiments of the present invention unless otherwise specified in the description of any one of those other preferred embodiments thereof.

Figure 4:
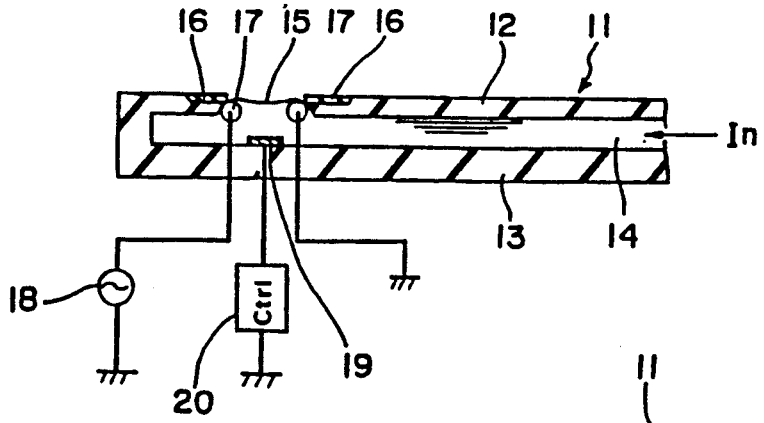
FIG. 4 is a schematic sectional view of a second preferred embodiment of the present invention.
Figure 5:
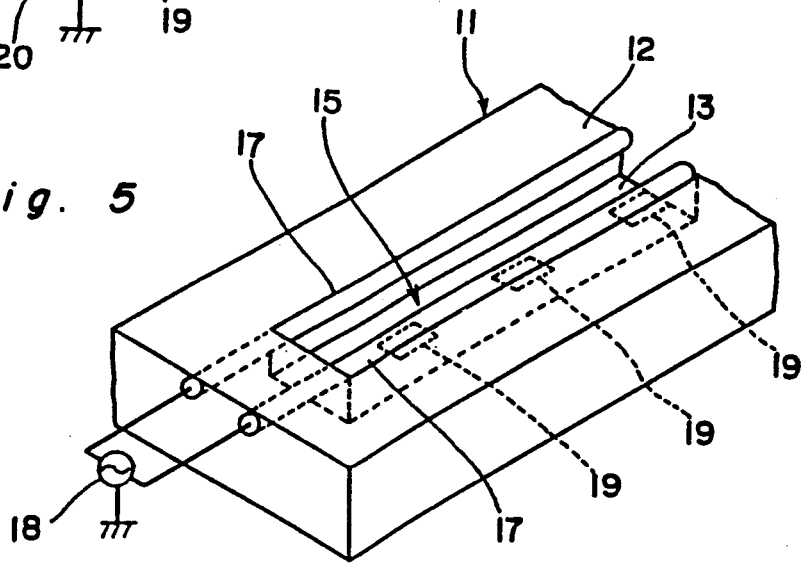
FIG. 5 is a fragmentary perspective view of the second preferred embodiment of the present invention.

Second Embodiment (FIGS. 4 and 5)

The printer head generally identified by 11 in FIGS. 4 and 5 according to the second preferred embodiment of the present invention comprises a nozzle casing including upper and lower panel members 12 and 13 of electrically insulating material positioned one above the other so as to define a nozzle 14. The upper panel member 12 has a slit-shaped orifice 15 defined therein and also an insulating lining 16 formed on that portion of an external surface of the upper panel member 12 which surrounds the orifice 15, said insulating lining 16 having no affinity to an inking solution In used. Within the orifice 15, there is disposed two wire electrodes 17 which extend parallel to each other and also to the slit-shaped orifice 15 and are connected with an alternating power source 18. A plurality of charge injecting electrodes 19 are disposed on the inner surface of the lower panel member 13 in equally spaced relationship while held in face-to-face relationship with the slit-shaped orifice 15, each of said charge injecting electrodes 19 being electrically connected with an individual driver IC 20 through a suitable wiring.

While the printer head 11 is so constructed as hereinbefore described, it operates in the following manner. The inking solution In within the nozzle 14 flows by the capillary action within the nozzle 14 while somewhat electrically charged as a result of its contact with the surrounding inner surface of the nozzle 14, as is the case with the printer head 1 according to the first preferred embodiment of the present invention.

When the alternating voltage from the alternating power source 18 is applied to the wire electrodes 17, an electric field curtain can be developed between the wire electrodes 17 and in the vicinity thereof. Consequent upon the formation of the electric field curtain, the inking solution In present in the vicinity of the orifice 15 and electrically charged as a result of contact with the nozzle 14 are affected by the electric field curtain because of a triggering action brought about by the electric charge built up in the inking solution upon contact with the nozzle 14. The portion of the inking solution In situated below the wire electrodes 17 within the nozzle 14 is then urged downwardly while another portion of the inking solution In situated above the wire electrodes 7 within the nozzle 14 are urged upwardly. However, by the action of a gravitational force and the surface tension, no inking solution In will be neither dropped nor expelled outwardly from the orifice 15.

Starting from this condition, and when image signals are supplied to the individual charge injecting electrodes 19 in correspondence with image information, an electric charge is injected from the charge injecting electrodes 19 into portion of the inking solution In situated in the vicinity of the wire electrodes 17 and, consequently, the electric field curtain force acting on that portion of the inking solution In situated at an area in the vicinity of the wire electrodes 17 is increased. When this electric field curtain force increases to such an extent as to overcome the surface tension, that portion of the inking solution In situated at the area in the vicinity of the wire electrodes 17 within the nozzle 14 is expelled outwardly from the nozzle 14 through the orifice 15 and towards a recording medium (not shown) such as, for example, a web of paper.

When the charge injection is interrupted and the charge injecting electrodes 19 are electrically grounded, the electric charge once built up in that portion of the inking solution In within the area in the vicinity of the wire electrodes 17 is erased and consequently flows towards the orifice 15 to fill up a space left there by that portion of the inking solution which has been expelled outwardly from the nozzle 14 through the orifice 15. The inking solution In flowing towards the orifice 15 to fill up the space referred to above is again somewhat electrically charged in contact with the surrounding inner wall surface of the nozzle 14.

So far illustrated, each of the charge injecting electrodes 19 best shown in FIG. 5 is of a generally rectangular shape. However, other than the rectangular shape, each charge injecting electrodes 19 which can be employed in the practice of the present invention may have such a shape having at least one pointed end as shown in any one of FIGS. 33(*a*) to 33(*h*) in top plan view and such a cross-sectional shape as shown in any one of FIGS. 33(*i*) to 33(*n*). Where the charge injecting electrodes 19 each having the at least one pointed end are employed, the charge injecting efficiency can be advantageously increased and are therefore superior to the charge injecting electrodes having no pointed end, in respect of the distance over which the inking solution can be expelled, the response to the discharge frequency and the resistance to tone repetition.

Figure 6:
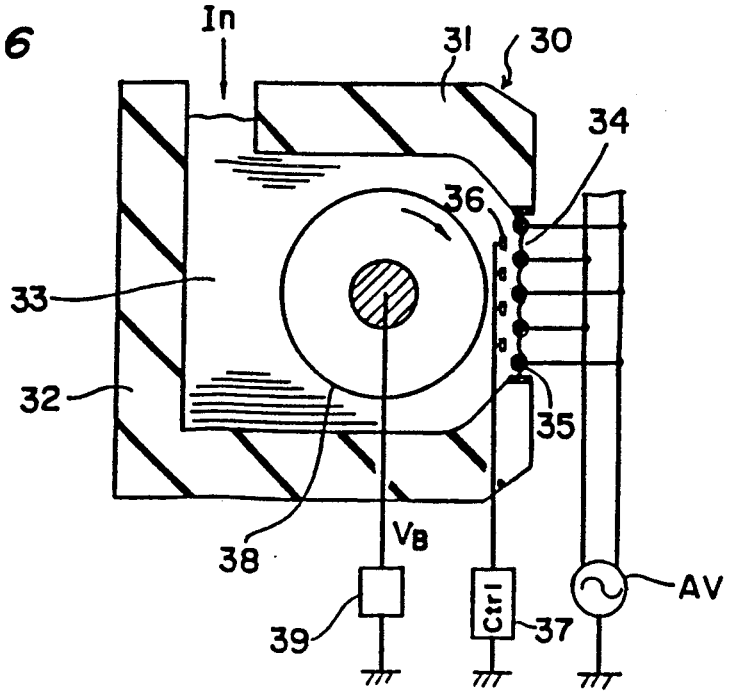
FIGS. 6 and 7 are schematic longitudinal sectional views of the printer head according to third and fourth preferred embodiments of the present invention, respectively.

Third Embodiment (FIG. 6)

The printer head according to the third preferred embodiment of the present invention is generally identified by 30 in FIG. 6. This printer head 30 comprises a nozzle casing including upper and lower panel members 31 and 32 assembled together to form a nozzle 33 having a slit-shaped orifice defined at 34. A plurality of, for example, five, wire electrodes 35 are disposed in the slit-shaped orifice 34 and extend parallel to the lengthwise direction of the slit-shaped orifice 34, these wire electrodes 35 being connected with an alternating power source AV. Charge injecting electrodes 36 are disposed in equally spaced relationship with each other within the nozzle 33 inwardly of the wire electrodes 34 with each charge injecting electrode 36 confronting a portion intermediate between the neighboring wire electrodes 35. These charge injecting electrodes 36 are in turn connected with a switching element 37.

The printer head shown in FIG. 6 also comprises a generally cylindrical ink replenishing roller 38 supported rotatably within the nozzle 33 and disposed on one side of the charge injecting electrodes 36 remote from the wire electrodes 35. This ink replenishing roller 38 is made of material having an affinity with the inking solution used and is adapted to receive a bias voltage $V_B$ supplied from a bias power source 39.

While the printer head 30 according to the third preferred embodiment of the present invention is so constructed as hereinabove described, it operates in the following manner.

Based on the rotation of the ink replenishing roller 38, the inking solution In supplied into the nozzle 33 is conveyed towards an area within the nozzle 33 and between the ink replenishing roller 38 and the orifice 34. Since at this time the bias voltage $V_B$ is applied from the bias power source 39 to the ink replenishing roller 38, an electric charge can be injected into a portion of the inking solution In then in contact with the ink replenishing roller 38.

When the alternating voltage from the alternating power source 35 is applied to the wire electrodes 35, an electric field curtain can be developed in the vicinity of each neighboring wire electrodes 35. Consequent upon the formation of the electric field curtain, a portion of the inking solution In adjacent the orifice 34 receives the electric field curtain force while being urged inwardly into the nozzle 3 by the action of the surface tension. Accordingly, no inking solution In will neither leak nor be expelled outwardly from the nozzle 33 through the orifice 34.

Starting from this condition, and when a voltage signal corresponding to image information is supplied to the individual charge injecting electrodes 36, an electric charge is injected from the charge injecting electrodes 36 into portion of the inking solution In situated at an area between the charge injecting electrodes 36 and the wire electrodes 35 and, consequently, that portion of the inking solution In situated at that area is expelled outwardly from the nozzle 33 through the orifice 34, in a quantity proportional to the amount of the electric charge injected, and towards a recording medium (not shown) such as, for example, a web of paper.

When the switching element 37 is switched off, the electric charge once built up in that portion of the inking solution In at that area is erased and consequently flows towards the orifice 15 to fill up a space left between each neighboring wire electrodes 35. It is to be noted that, since the inking solution In is delivered towards the orifice 34 by the rotation of the ink replenishing roller 38, the above described replenishment can take place quickly.

In the foregoing description of the third preferred embodiment of the present invention, the ink replenishing roller 38 has been shown and described as applied with the bias voltage $V_B$, it is not always essential to apply the bias voltage to the ink replenishing roller 38. However, the application of the bias voltage such as described above is advantageous in that the inking solution In can be preliminarily charged electrically and, therefore, the load which may be imposed on a driver IC for applying a voltage to the charge injecting electrodes 36 in correspondence with the image information can be lessened.

Figure 7:
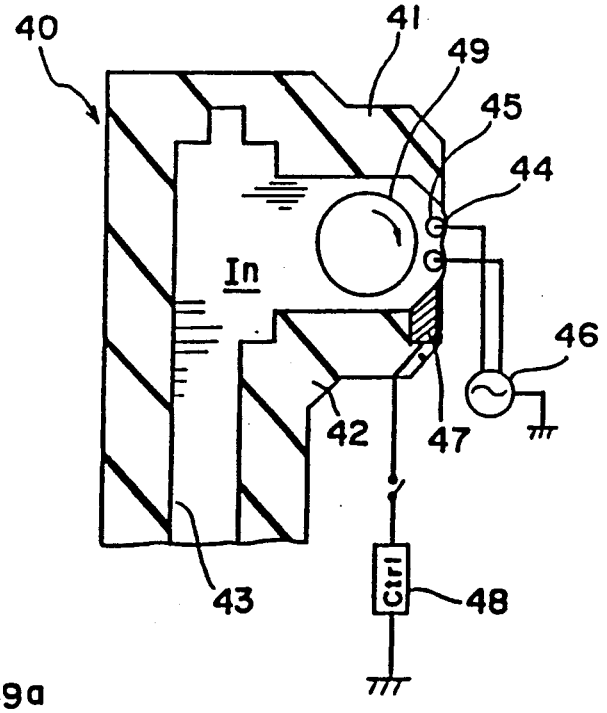
Figure 8:
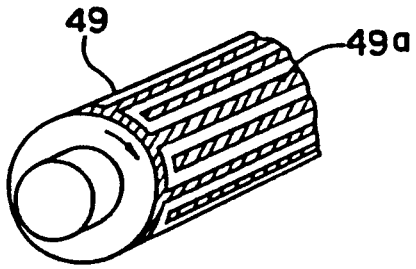
FIG. 8 is a fragmentary perspective view of an ink supply roller.

Fourth Embodiment (FIGS. 7 and 8)

The printer head according to the fourth preferred embodiment of the present invention is generally identified by 40 in FIG. 7 and comprises a nozzle casing including upper and lower panel members 41 and 42 assembled together to form a nozzle 43 having a slit-shaped orifice defined at 44. A plurality of, for example, two, wire electrodes 45 are disposed in the slit-shaped orifice 44 and extend parallel to the lengthwise direction of the slit-shaped orifice 44, these wire electrodes 45 being connected with an alternating power source 46. Charge injecting electrodes 47 are partially embedded in respective portions of the lower panel member 42 adjacent the orifice 44 and are connected with a switching element 48.

The printer head shown in FIG. 7 also comprises a generally cylindrical ink replenishing roller 49 supported rotatably within the nozzle 43 and disposed on one side of the wire electrodes 45 opposite to the orifice 44. This ink replenishing roller 49 is made of material, such as, for example, stainless steel, having an affinity with the inking solution used and has its outer peripheral surface formed with patterns 49*a* which are continued in a direction parallel to the axis of rotation of the ink replenishing roller 49. This patterns 49*a* have an affinity with the inking solution In used and are formed by depositing, for example, silicon dioxide by the use of any known vapor-deposition technique.

While the printer head 40 according to the fourth preferred embodiment of the present invention is so constructed as hereinabove described, it operates in the following manner.

Based on the rotation of the ink replenishing roller 49, the inking solution In supplied into the nozzle 43 is conveyed towards an area confronting the orifice 44 in a line fashion. During the conveyance of the inking solution In towards that area confronting the orifice 44 during the rotation of the ink replenishing roller 49, the inking solution In is somewhat electrically charged as a result of contact thereof with the surrounding inner wall surface of the nozzle 43.

When an alternating voltage from the alternating power source 46 is applied to the wire electrodes 45, an electric field curtain can be developed in the vicinity of the wire electrodes 45. Consequent upon the formation of the electric field curtain, a portion of the inking solution In inwardly of the wire electrodes 45 is urged towards the toner replenishing roller 49 because of a triggering action brought about by the electric charge built up in the inking particles upon contact with the nozzle 43, while another portion of the inking solution In outwardly of the wire electrodes 45 receives the electric field curtain force acting in an outward direction. However, no inking solution In will not be expelled outwardly from the nozzle 43 through the orifice 34 because of the surface tension developed therein.

When the switching element 48 is switched on and off in correspondence with image information and when the electric charge is thus injected from the charge injecting electrodes 47 into the inking solution In, the electric field curtain force acting on the inking solution In increases, allowing a portion of the inking solution In situated between the wire electrodes 44 can be expelled outwards into the air through the nozzle 44 and then towards a recording medium (not shown).

It is to be noted that the length of time during which the toner replenishing roller 49 is rotated is selected to correspond to the time required for that portion of the inking solution In to be discharged outwardly from the nozzle 43 after a data of maximum tone for one dot has been supplied. Also, the number of the patterns 49*a* in a circumferential direction of the toner replenishing roller 49 may be either equal to the number of data of maximum tone or greater than it.

With the above described construction, it is possible to cause the inking solution In to be assuredly expelled outwardly from the nozzle 43 in correspondence with the charge injected from the charge injecting electrodes 47 and, therefore, the discharge response can be increased with recording speed accelerated substantially. Also, the amount of the inking solution supplied to that area confronting the orifice 44 for a unitary time can be stabilized and, therefore, it is possible to make the diameter of each dot uniform, thereby contributing to an improvement in resolution and also in reproducibility.

A method for forming the patterns having an affinity, or no affinity, with the inking solution In on the outer peripheral surface of the ink replenishing roller 49 may not be always limited to that described hereinabove, and they may be formed by processing the outer peripheral surface of the roller 49 with fluorine resin such as, for example, polytetrafluoroethylene, to render it to have a hydrophobic property and then subjecting a portion thereof to an oxygen plasma process to form the hydrophilic patterns.

Figure 9:
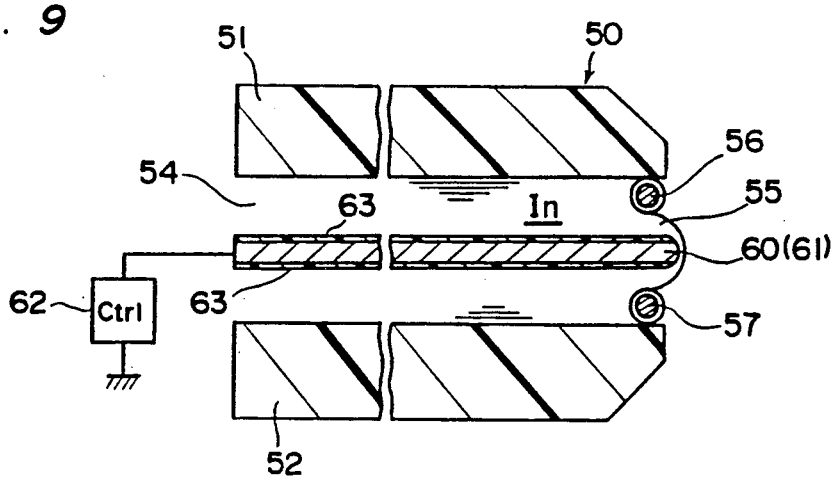
FIG. 9 is a schematic longitudinal sectional view of the printer head according to a fifth preferred embodiment of the present invention.
Figure 10:
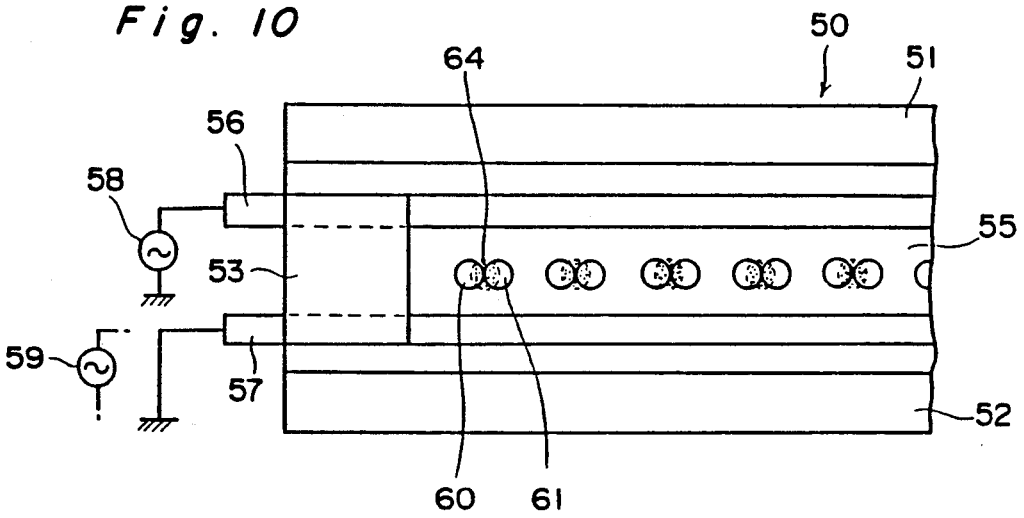
FIG. 10 is a schematic front elevational view of a portion of the printer head shown in FIG. 9.

Fifth Embodiment (FIGS. 9 and 10)

The printer head according to the fifth preferred embodiment of the present invention is generally identified by 50 in FIGS. 9 and 10 and is of a construction generally identical with that according to the first preferred embodiment shown in and described with reference to FIG. 1. Specifically, the printer head 50 comprises a nozzle casing including upper and lower panel members 51 and 52 positioned one above the other through spacers 53 so as to define a nozzle 54. Each of the upper and lower panel members 51 and 52 has an inner surface facing interiorly of the nozzle 54 that is processed to have an affinity to an inking solution In used.

The nozzle casing including the upper and lower panel members 51 and 52 is open at 55 so as to define a slit-shaped orifice between respective side faces of the upper and lower panel members 51 and 52. Within the orifice 5, there is disposed upper and lower wire electrodes 56 and 57, said upper wire electrode 56 being connected with an alternating power source 58 while the lower wire electrode 57 is connected with the ground or an alternating power source 59. Each of these upper and lower wire electrodes 56 and 57 is lined with insulating material.

A plurality of pairs of charge injecting electrodes 60 and 61 are disposed in equally spaced relationship within the nozzle 54 intermediate the upper and lower panel members 51 and 52 while oriented towards the slit-shaped orifice 55 so that the tip of each of the charge injecting electrodes 60 and 61 of each pair can assume a position intermediate the upper and lower wire electrodes 56 and 57. One of the charge injecting electrodes 60 and 61 of each pair is electrically connected at the opposite end with a driver IC 62 while the other of the charge injecting electrodes 60 and 61 is connected at the opposite end with the ground. Even each of the paired charge injecting electrodes 60 and 61 is sheathed with insulating lining 63 except for the tips thereof and is processed to have the affinity to an inking solution In used.

While the printer head 50 according to the fifth preferred embodiment of the present invention is so constructed as hereinabove described, it operates in the following manner.

The inking solution In is supplied into the nozzle 54 from a suitable source of inking solution (not show). The inking solution In so supplied flows within the nozzle 54 by the capillary action while somewhat electrically charged in contact with the inner wall surfaces of the upper and lower panel members 51 and 52 forming the nozzle casing.

When an alternating voltage from the alternating power source 58 is applied to the wire electrodes 56 and 57, an electric field curtain can be developed between and in the vicinity of the upper and lower wire electrodes 56 and 57. At this time, a portion of the inking solution In adjacent the orifice 55 is retained in position within the orifice 55 without being discharged outwardly from the nozzle 54.

Starting from this condition, and when a signal corresponding to image information is supplied to the individual charge injecting electrodes 60 and 61 of each pair, a point charge is formed between the paired charge injecting electrodes 60 and 61 with the result that the electric field curtain force acting on a portion of the inking solution In adjacent the paired charge injecting electrodes 60 and 61 is increased to such an extent as to overcome the surface tension. Consequently, that portion of the inking solution In situated at that area is expelled outwardly from the nozzle 54 through the orifice 55 and towards a recording medium (not shown) such as, for example, a web of paper.

Thus, according to the fifth embodiment of the present invention, since the point charge is developed in the vicinity of the respective tips of the paired charge injecting electrodes 60 and 61 which are disposed substantially intermediate of the nozzle 54 so that that portion of the inking solution In at that area can be expelled outwards from the nozzle 54 through the orifice 55, the position at which the inking solution is expelled is stabilized and, therefore, the inking solution In expelled can be advantageously deposited at a predetermined position on the recording medium.

Figure 11:
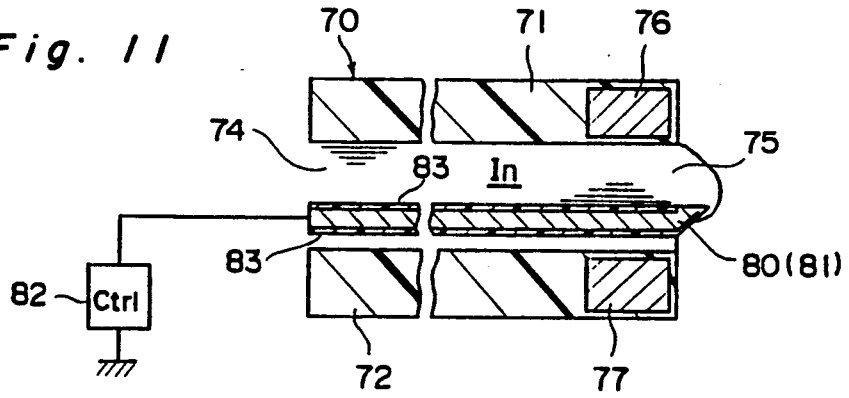
FIG. 11 is a schematic longitudinal sectional view of the printer head according to a sixth preferred embodiment of the present invention.
Figure 12:
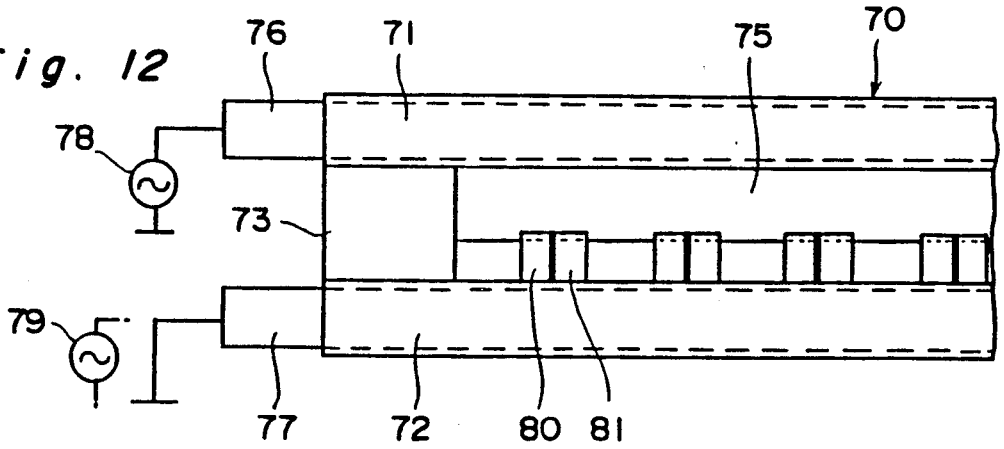
FIG. 12 is a schematic front elevational view of a portion of the printer head shown in FIG. 11.

Sixth Embodiment (FIGS. 11 and 12)

The printer head according to the sixth preferred embodiment of the present invention is shown in FIGS. 11 and 12 and generally identified by 70. As is the case with the printer head according to the previously described embodiment, the printer head 70 comprises a nozzle casing including upper and lower panel members 71 and 72 positioned one above the other through spacers 73 so as to define a nozzle 74 having a slit-shaped orifice defined at 75. Wire electrodes 76 and 77, one connected with an alternating power source 78 and the other with the ground or an alternating power source 79, are embedded in respective side edge portions of the upper and lower panel members 71 and 72 adjacent the slit-shaped orifice 75.

As is the case with the printer head according to the previously described embodiment of the present invention, a plurality of pairs of charge injecting electrodes 80 and 81 are disposed in equally spaced relationship within the nozzle 74. Even each of the paired charge injecting electrodes 80 and 81 is sheathed with insulating lining 83 except for the tip thereof which is pointed to represent an acute-angled tip.

It is to be noted that reference numeral 82 represents a driver IC for supplying an electric power necessary to accomplish a charge injection.

According to the sixth preferred embodiment of the present invention, since the extent to which the electric charge is concentrated at the acute-angled tips of the paired charge injecting electrodes 80 and 81 is relatively high, the point charge (not shown) can be easily formed so the position at which the inking solution is expelled is more stabilized, allowing the outwardly expelled inking solution In to be advantageously deposited at a predetermined position on the recording medium.

Figure 13:
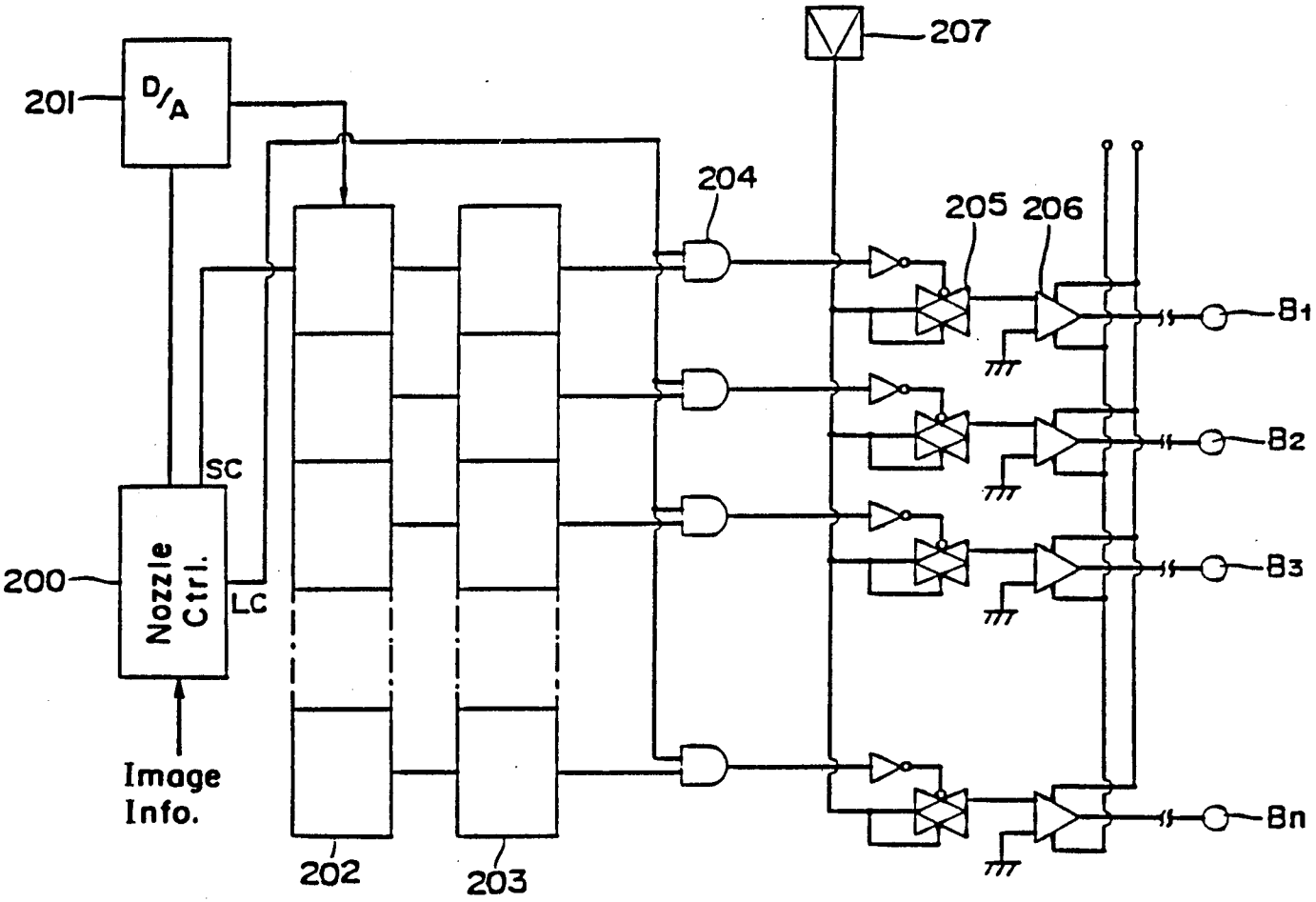
FIG. 13 is a block circuit diagram showing a control circuit.

Embodiment of Print Control (FIG. 13)

The details of a print control unit operable to output the image information to the charge injecting electrodes employed in the printer head according to any one of the foregoing embodiments of the present invention will now be described with particular reference to FIG. 13.

Image recording information inputted from a host computer, an image reader, a video camera, a still video camera or the like and divided into picture elements, is arithmetically processed in a nozzle control circuit 200 which subsequently outputs a digital signal having a particular tone for each picture element. This digital signal is then supplied to a digital-to-analog converter (D/A) 201 for conversion into a corresponding analog signal. The analog signal so outputted from the converter 201 is subsequently sequentially transferred to an analog shift register 202 in synchronism with a shift clock SC so that an analog image signal corresponding to one line can be retained in the analog shift register 202. The analog image signal corresponding to one line that is retained in the analog shift register 202 is outputted for each picture element to a converter 203 which operates to convert it into a pulse data in correspondence with a voltage value.

Figure 14:
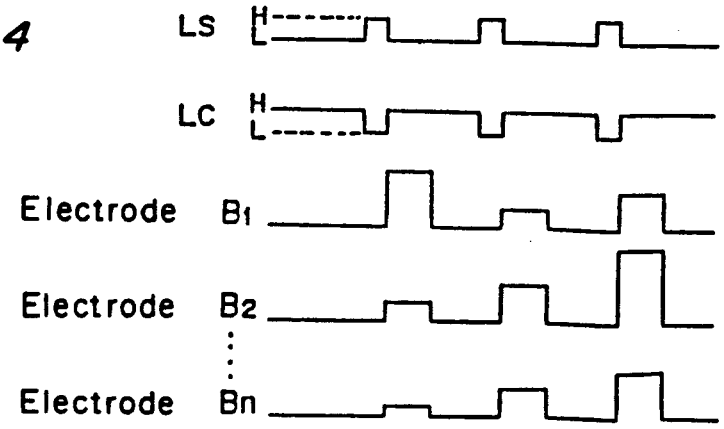
FIG. 14 is a timing chart.

When a line signal LC supplied from the nozzle control circuit 200 to individual AND gate 204 is brought into a high level state, both of analog switches 205 and corresponding amplifiers 206 connected between a DC power source 207 and a group of associated electrodes B1, B2, . . . $Bn_{-1}$ and Bn are driven in response to the pulse data to apply a DC voltage proportional to the respective pulse data to the associated electrodes B1, B2, . . . $Bn_{-1}$ and Bn. See FIG. 14.

The following preferred embodiments, i.e., seventh to fifteenth preferred embodiments, of the present invention pertain to the utilization of a travelling-wave electric field curtain, instead of the electric field curtain which is utilized in any one of the foregoing first to sixth preferred embodiments of the present invention. While the details thereof will be discussed later, the rendering the electric field curtain to be travelling-wave facilitate a replenishment of inking solution immediately after the printing, thereby to increase a response and/or to facilitate the charging of the inking solution.

Figure 15:
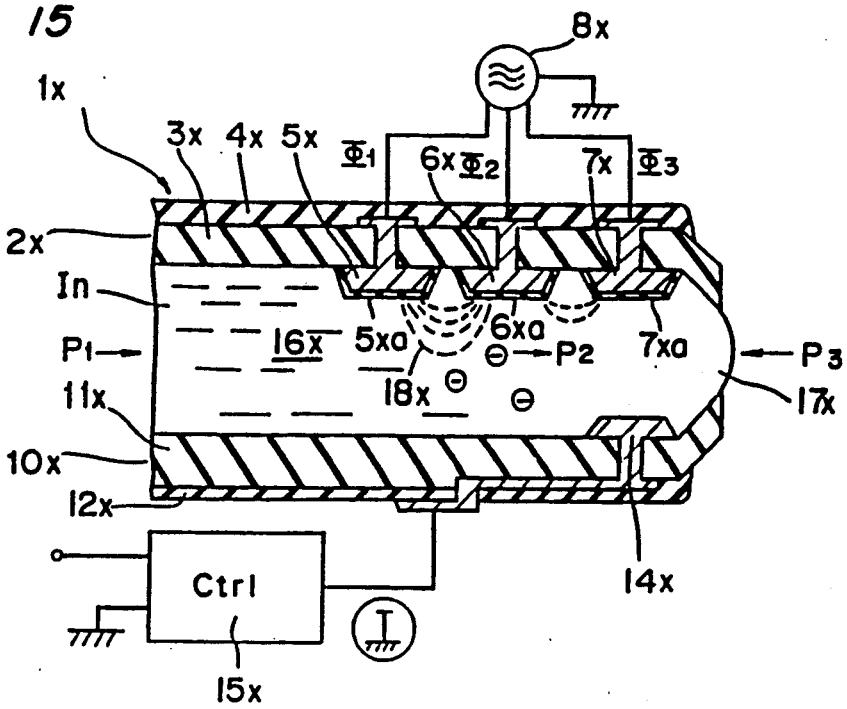
FIGS. 15 and 16 are fragmentary longitudinal sectional views of the printer head according to a seventh preferred embodiment of the present invention.
Figure 16:
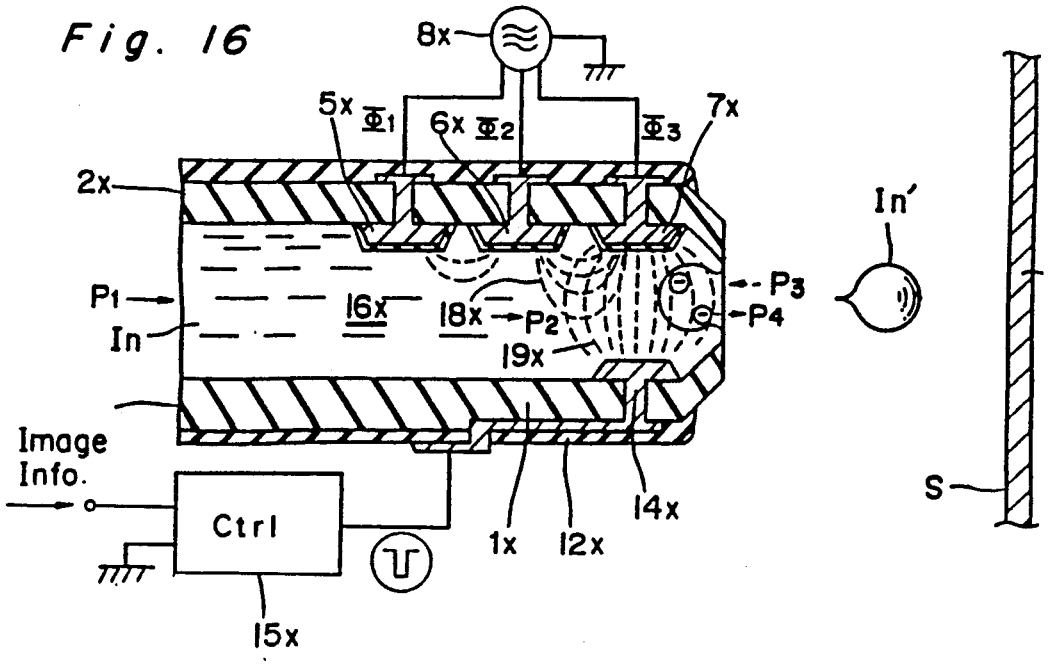
Figure 17:
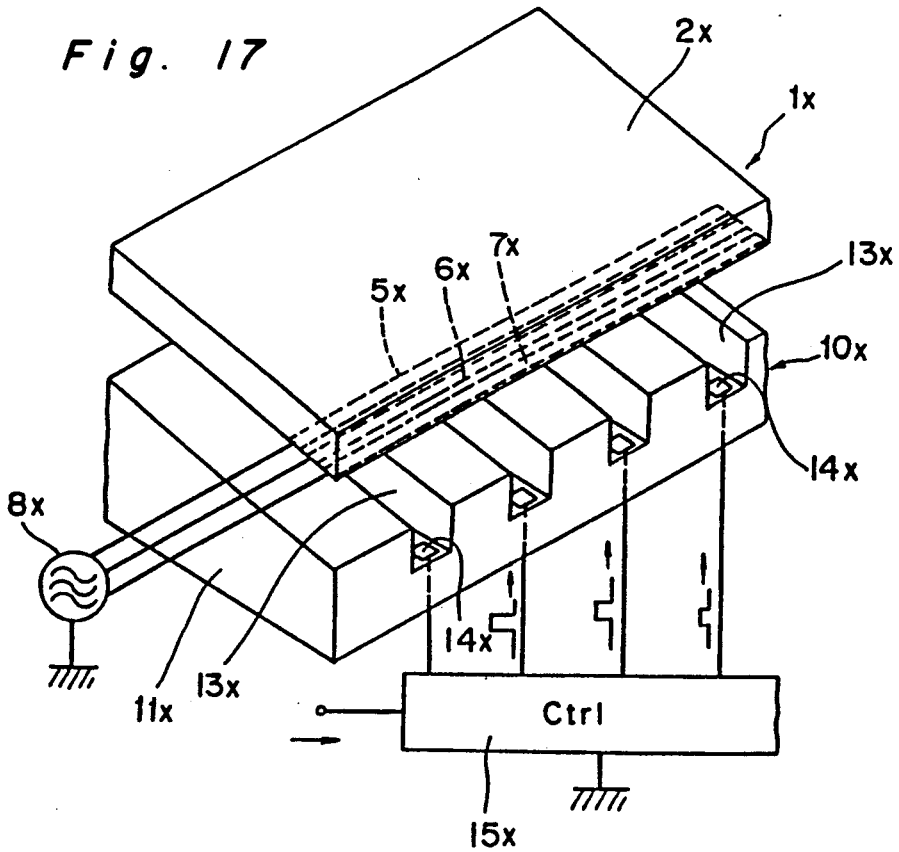
FIG. 17 is a fragmentary perspective view of the printer head shown in FIGS. 15 and 16.

Seventh Embodiment (FIGS. 15 to 17)

The printer head according to this seventh preferred embodiment of the present invention is shown generally by 1x in FIGS. 15 to 17. This printer head 1x comprises a nozzle casing including upper and lower panel members 2x and 10x positioned one above the other. The upper panel member 2x is constituted by an insulating base 3x having an upper or outer surface lined with an insulating layer 4x and has one side edge portion in which electric field curtain forming electrodes 5x, 6x and 7x are embedded in this specific order in a direction towards the side edge thereof while being partially exposed downwardly outwards through the insulating base 3x. Those respective portions of the electrodes 5x which are downwardly outwardly exposed have respective insulating linings 5xa, 6xa and 7xa formed thereon. These electrodes 5x, 6x and 7x are connected with three phases of a three-phase alternating power source 8x in phase-occurring sequence.

The lower panel member 10x is constituted by an insulating base 11x having a lower or outer surface lined with an insulating layer 12x and an upper or inner surface formed with a plurality of grooves 13x defined therein in parallel relationship with each other as best shown in FIG. 17. The lower panel member 10x has charge injecting electrodes 14x disposed at respective portions of bottoms of the grooves 13x adjacent and beneath the electrode 7x, each of said charge injecting electrodes 14x being connected with a respective print control circuit 15x. Each of the charge injecting electrodes 14x may have such an outer appearance and such a sectional shape as described in connection with the second preferred embodiment of the present invention.

As best shown in FIG. 17, the upper and lower panel members 2x and 10x are stacked one above the other so as to allow the grooves 13x to define respective nozzles 16x each having an orifice 17x at an open end of the associated groove 13x. The nozzles 16x are in turn communicated with an ink reservoir (not shown) from which an inking solution In is supplied.

The inking solution In may be either of a high resistance type containing electrically charged coloring particles dispersed therein or of a type capable of being electrically charged, such as employed in the practice of any one of the foregoing embodiments of the present invention.

The details of the three-phase alternating power source 8x will now be described. Even where a travelling-wave electric field curtain force is utilized as the electric field curtain force, the alternating electric power may be any one of the rectangular wave, the triangular wave and the sawtooth wave. Also, the alternating power source may be a source of three-phase alternating current, or a plurality of single-phase alternating current sources may be employed provided that the respective phases be differentiated from each other. In any event, any electric power source may be employed provided that the electric field curtain can be developed in a direction from rear of each nozzle 13x towards the associated orifice 17x.

With respect to the output of the electric power source for generating the travelling-wave electric field curtain force and its frequency, as is the case with those of the electric power source for generating the mere electric field curtain force in connection with the first preferred embodiment of the present invention, they depend considerably on the physical characteristics of the inking solution used and/or the shape of each nozzle. However, the electric power source is preferably of a type capable of providing an output of a peak-to-peak voltage Vp-p within the range of 50 to 2,000 volts, preferably 50 to 1,000 volts, and of a frequency f within the range of 50 to 10,000 Hz, preferably 100 to 5,000 Hz. In the illustrated embodiment of FIGS. 15 to 17, the three-phase alternating power source 8x is of a type wherein each phase has a frequency of 3 KHz and a peak-to-peak voltage Vp-p of 200 volts with $\frac{2}{3}\pi$ radians in phase difference between each neighboring phases.

While the printer head 1x is so constructed as hereinbefore described, it operates in the following manner.

When alternating voltages $\Phi_1$, $\Phi_2$ and $\Phi_3$ from the alternating power source 8x are applied to the wire electrodes 5x, 6x and 7x, respectively, in the phase occurring sequence (that is, in the direction of travel of the travelling-wave), travelling-wave unequal electric fields 18x travelling towards the associated orifices 17x are developed in spaces in the vicinity of and between each neighboring electrodes 5x, 6x and 7x as shown by dotted lines.

At the outset, the inking solution In within each nozzle 16x flows therein by the capillary action and is somewhat electrically charged (a trigger voltage) in contact with the surrounding inner wall surface of the respective nozzle 16x. Consequently, the inking solution In receives cyclically the travelling-wave electric field curtain force $P_2$ moving in a direction towards the respective orifice 17x because of a triggering action brought about by the trigger voltage. This travelling-wave electric field curtain force constantly acts on the inking solution In within the respective orifice 17x so long as the alternating power source 8x is switched on. In addition, a pressure $P_1$ used to supply the inking solution In or resulting from the head of the inking solution In acts on the inking solution In from rear, i.e., in a direction towards each orifice 17x. Therefore, at an area adjacent the respective orifice 17x, both the sum of the forces $P_1$ and $P_2$ acting within each nozzle 16x to urge the inking solution In towards the associated orifice 17x and the surface tension $P_3$ tending to draw the inking solution In inwardly of the respective nozzle 16x act on the inking solution In. However, by adjusting the output of the power source 8x, a portion of the inking solution In at that area adjacent the respective orifice 17x can be retained in position in a critical condition tending to travel outwardly from the nozzle 16x through the associated orifice 17x. In other words, that portion of the inking solution In within the orifice 17x is held in equilibrium.

Starting from this condition, and when voltages are supplied from the print control circuits 15x to the individual charge injecting electrodes 9 in correspondence with image information, an electric field 19x is formed between each of the charge injecting electrode 14x and the electrode 7x positioned immediately above such charge injecting electrode 14x and, as a result thereof, an electric charge is injected into the inking solution In with the result that the electric field curtain force (Coulomb force) $P_4$ oriented towards the associated orifice 17x acts on that portion of the inking solution In situated at that area delimited by the orifice 17x and the electrodes 7x and 14x. Once this occur, the equilibrium is destroyed, allowing that portion of the inking solution In to be expelled outwards and into the air in the form of an ink droplet In' of a quantity proportional to the amount of the electric charge built up thereon. The ink droplet In' is then deposited on a recording medium S such as, for example, a web of paper.

As described above, the inking solution In within each of the nozzle 16x is retained in position in the critical condition, as described above, under the influence of the travelling-wave electric field curtain cyclically acting thereon so as to transport the inking solution In towards the associated orifice. Therefore, the inking solution In retained in the critical condition can readily be expelled outwards from the nozzle through the associated orifice, when even the slightest electric charge is injected therein, in the form of the ink droplet In' of a size corresponding to the amount of electric charge so injected.

After the single ink droplet In' corresponding to one dot has left the corresponding orifice 17x, a space defined within the respective nozzle 16x inwardly of the corresponding orifice 17x as a result of the discharge of the ink droplet In' therefrom is filled up by the inking solution In from rear. At this time, the inking solution In replenishing to fill up the space referred to above is electrically charged in contact with the surrounding inner wall surface of the respective nozzle 16x while receiving a force, resulting from the travelling-wave electric field curtain 18x, tending to urge the inking solution In towards the orifice 17x and, therefore, the ink droplet can be expelled outwards from the respective nozzle 16x through the associated orifice 17x. In general, the higher the frequency of the output, the smaller the size of the expelled ink droplet.

The charge injecting electrodes 14x are, as shown in FIG. 15, connected to the ground as is the case with an initial condition, and residue electric charge remaining in the inking solution In is erased. However, where the inking solution In is electrically charged by induction charging or by internal polarization, the charge injecting electrodes 14x may not be essentially grounded.

It is to be noted that, where the electric charge is to be injected into the inking solution In, the electric charge if negative in polarity exhibits a relatively high velocity of movement and, therefore, the application of a negative voltage to each of the charge injecting electrode 14x is preferred. Needless to say, where the inking solution whose physical characteristics have been conditioned so as to render it to exhibit a relatively high velocity of movement, a positive voltage is of course applied to each charge injecting electrode.

Figure 18:
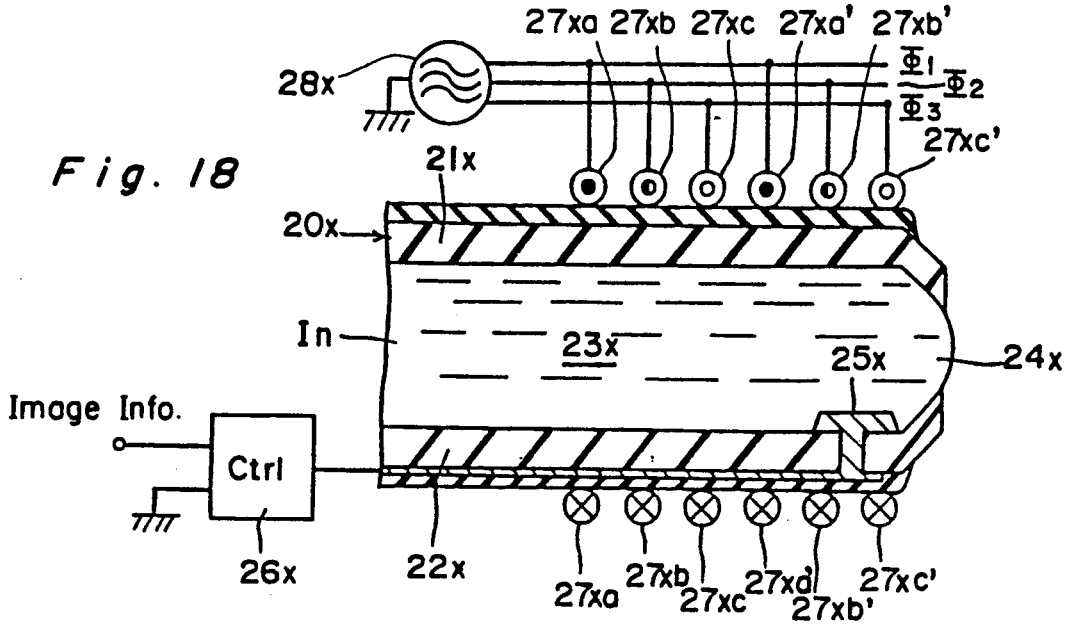
FIG. 18 is a schematic longitudinal sectional view of the printer head according to an eighth preferred embodiment of the present invention.
Figure 19:
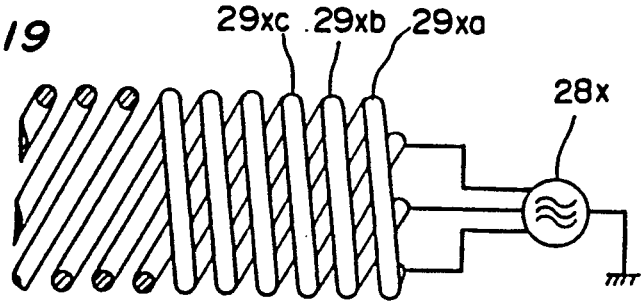
FIG. 19 is a fragmentary top plan view of an electrode used to develop an electric field curtain.

Eighth Embodiment (FIGS. 18 and 19)

The printer head according to this eighth embodiment of the present invention is generally identified by 20x in FIGS. 18 and 19 and comprises a nozzle casing including upper and lower panel members 21x and 22x of insulating material assembled together to define nozzles 23x therebetween. For each nozzle 23, the lower panel member 22x has a charge injecting electrode 25x disposed therein and electrically connected with a print control circuit 26x. Coils 27xa, 27xb and 27xc are would on an upper surface of the printer head 20x so as to extend in a direction perpendicular to the nozzles 23 while coils 27xa', 27xb' and 27xc' are wound on a lower surface of the printer head 20x so as to extend in a direction perpendicular to the nozzles 23, every second coil being connected with a three-phase alternating power source 28x. FIG. 19 has, in practice, a length parallel to the lengthwise direction of the printer head 20x, which lies in a direction perpendicular to the plane of the drawing thereof.

In the printer head according to the eighth embodiment of the present invention shown in and described with reference to FIGS. 18 and 19, when alternating voltages $\Phi_1$, $\Phi_2$ and $\Phi_3$ are applied to the coils 27xa, 27xb, 27xc, 27xa', 27xb' and 27xc' in a phase occurring sequence, rows of travelling-wave alternating unequal electric fields moving in a direction towards the orifices 24x are formed and, therefore, the electrically charged inking solution In cyclically receives the respective electric field curtain forces oriented towards the orifices 24x. At each of the orifices 24x, a portion of the inking solution In adjacent the respective orifice 24x is held in a condition in which it would not barely be expelled outwards.

Starting from this condition, and when a voltage is applied to each charge injecting electrode 25x, an electric field is developed between the respective charge injecting electrode 25x and the coils on the upper panel member 21x and, as a result thereof, an electric charge is injected into the inking solution In, allowing that portion of the inking solution In adjacent the respective orifice 24x to be expelled into the air under the influence of the electric field curtain force acting in the direction towards such orifice 24x.

It is to be noted that, as the electrodes used to form the electric field curtains, three coils 29xa, 29xb and 29xc such as shown in FIG. 19 may be spirally wound around an outer periphery of the panel members 21x and 22x.

It is to be noted that the print control circuit which has been described following the sixth preferred embodiment and preceding the seventh embodiment of the present invention can be employed in connection with the printer head according to any one of the seventh and eighth embodiments of the present invention.

Figure 20:
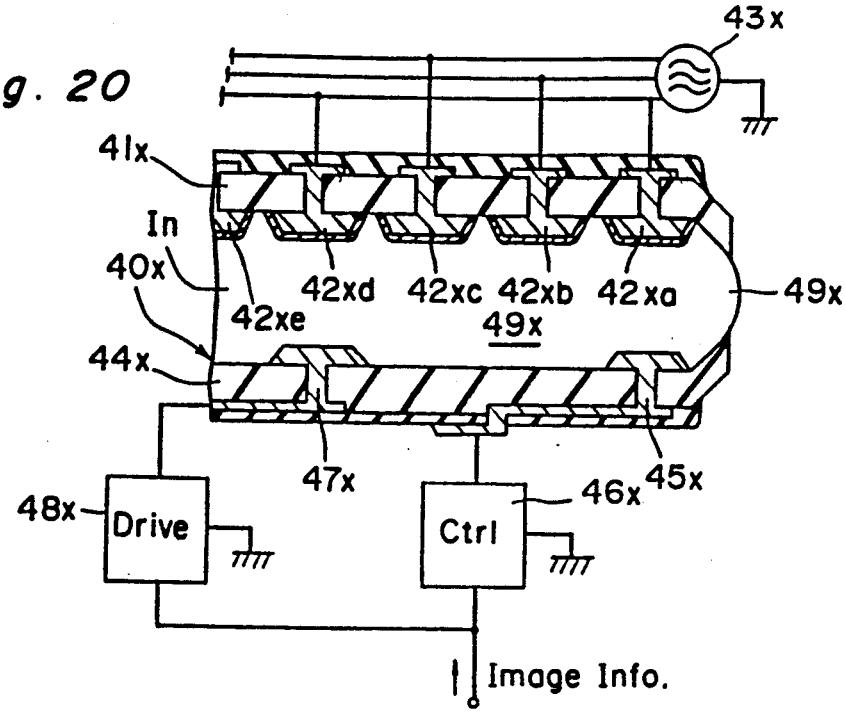
FIG. 20 is a schematic longitudinal sectional view of the printer head according to a ninth preferred embodiment of the present invention.
Figure 21:
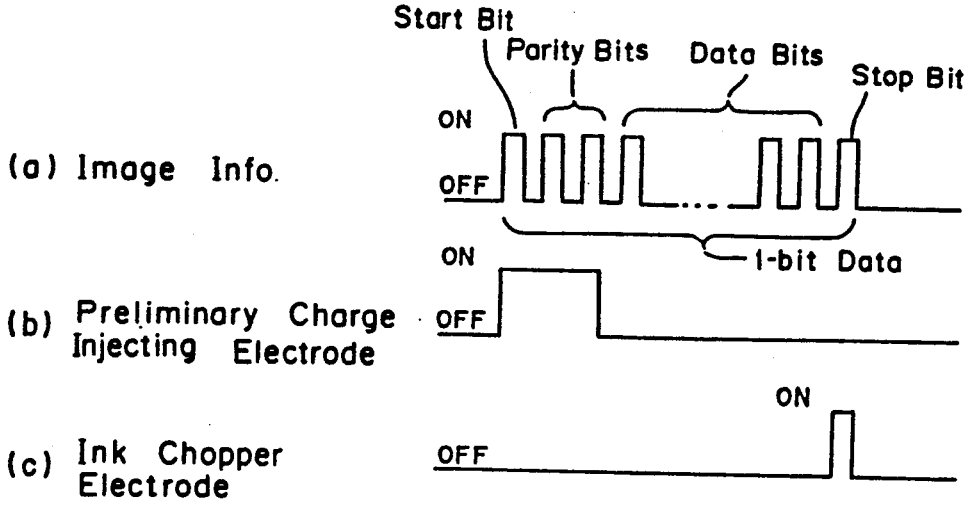
FIG. 21 is a timing chart showing output signals, including image information, shown in timed relationship.

Ninth Embodiment (FIG. 20 and FIGS. 21(a) and 21(b))

The printer head according to this ninth embodiment of the present invention is generally identified by 40x and comprises a nozzle casing including upper and lower panel members 41x and 44x. The upper panel member 41x has an inner surface provided with a plurality of electric field curtain forming electrodes 42xa, . . . , every second electrode being connected to a three-phase alternating power source 43x. A portion of each of the electrodes 42xa, . . . which is exposed is covered by an insulating lining.

The lower panel member 49x is provided with charge injecting electrodes 45x, one for each nozzle 49, positioned in the vicinity of a respective orifice. These charge injecting electrodes 45x are connected with a print control circuit 46x. A preliminary charge injecting electrode 47x is provided rearwardly of the charge injecting electrode 45x with respect to the direction towards the orifice and is connected with a driving circuit 48x. Both of the print control circuit 46x and the driving circuit 48x are adapted to receive image information.

In the printer head 40x shown in FIG. 20, voltages from the three-phase alternating power source are applied to the electric field curtain forming electrodes 42xa, . . . , to form travelling-wave unequal alternating electric fields each oriented towards the respective orifice 49xa and, therefore, the inking solution In cyclically receive an action for conveying it towards each orifice 49xa.

Then, image information is inputted to both of the print control circuit 46x and the driving circuit 48x. The image information is, nevertheless, limited to the number of data appropriate to the capability of an input device and may be composed of a 12-bit signal for a 1-dot data in order for it to have a capability of 256 tones per dot by means of, for example, an optical CCD sensor, and only during the period in which a start bit, which is first inputted, and the next succeeding parity bits are being detected, the driving circuit 48x applies a voltage to each preliminary charge injecting electrode 47x to accomplish a preliminary charge injection into the inking solution In to cause the latter to be electrically charged. It is, however, to be noted that, where the inking solution is an electro-conductive ink having an electric resistance lower than a certain value, for example, lower than $1\times10^5$ Ω.cm, simultaneous switching on of the electrodes 47x and 45x may facilitate a current-induced heating which would result in formation of bubbles in the inking solution. The formation of the bubbles in the inking solution may obstruct the discharge of ink outwardly from each orifice 49xa and, therefore, it is recommended that the electrodes 45x can be switched on a predetermined length of time subsequent to the switching on of the electrodes 47x.

The print control circuit 46x reads the image information from 8-bit data bits inputted subsequent to the parity bits and applies to each charge injecting electrode 45x a voltage corresponding to the image information, thereby to producing an electric field between the respective charge injecting electrode 45x and the associated electric field curtain forming electrodes 42xa, . . . so that the electric charge can be injected into the inking solution In to impart a force, acting in a direction towards the respective orifice 49xa, to a portion of the inking solution situated between the electrodes 45x and 42xa and the orifice 49xa, allowing that portion of the inking solution In to be expelled into the air through the respective orifice 49xa.

Thus, in the printer head 40x according to the ninth embodiment of the present invention, the inking solution In is preliminarily charged electrically or induced to have an electric charge and, therefore, even with the high-resistance inking solution having an electric resistance now lower than $1\times10^7$ to $1\times10^8$ Ω, the movement of the electric charge can be facilitated to allow the inking solution to be quickly and readily expelled with no substantial delay in response. Nevertheless, the voltage to be applied to each preliminary charge injecting electrode 47x is controlled to a value enough to avoid any premature discharge of the inking solution outwardly from the respective orifice 49xa as a result of the preliminary electric charge injection.

Figure 22:
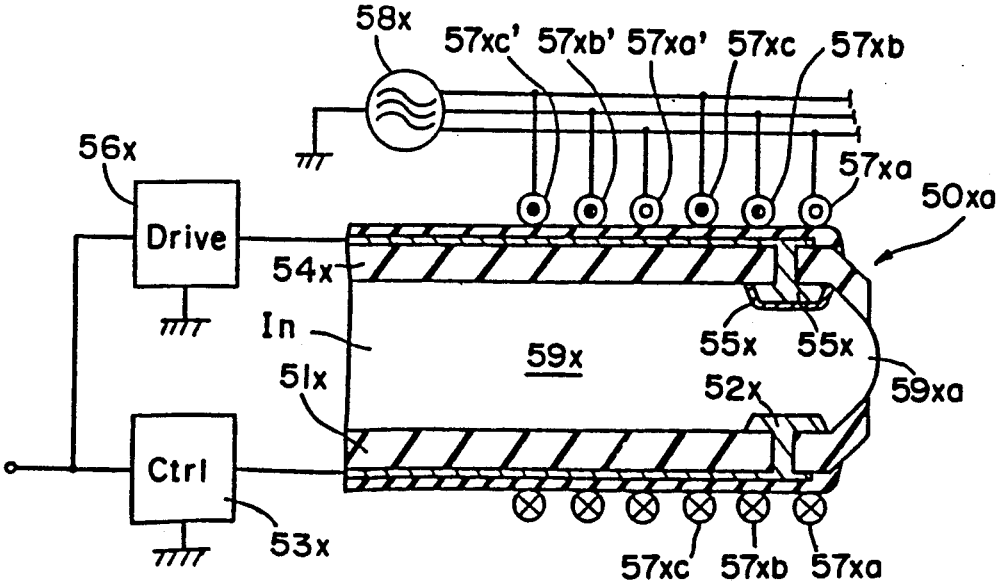
FIG. 22 is a schematic longitudinal sectional view of the printer head according to a tenth preferred embodiment of the present invention.

Tenth Embodiment (FIG. 22 and FIG. 21(c)):

The printer head according to this tenth embodiment of the present invention is generally identified by 50x and comprises a nozzle casing having an orifice defined at 50xa. The nozzle casing comprises lower and upper panel members 51 and 54 assembled together to define a nozzle 59x communicated with the orifice 59xa. As is the case with the printer head according to the eighth embodiment of the present invention shown in and described with reference to FIG. 18, coils 57xa, 57xb, 57xc, 57xa', 57xb' and 57xc' are wound exteriorly around the lower and upper panel members 51x and 54x in parallel relationship and every second coil is connected with a three-phase alternating power source 58x.

The lower panel member 51x has a charge injecting electrode 52x disposed at a portion thereof adjacent the orifice 59xa and exposed into the nozzle 59x, said charge injecting electrode 52x being electrically connected with a print control circuit 53.

On the other hand, the upper panel member 54x has a counter electrode 55x disposed at a portion thereof adjacent the orifice 59xa in face-to-face relationship with the charge injecting electrode 52x and partially exposed into the nozzle 59x. That portion of the counter electrode 55x which is exposed into the nozzle 59x is covered by an insulating lining 55xa.

With the printer head 50x so constructed as hereinabove described, when voltage from the three-phase alternating power source 58x are supplied to the respective coils 57xa, . . . , travelling-wave electric field curtains are formed in the vicinity of and between each neighboring coils 57xa, . . . and, therefore, the inking solution In within the nozzle 59x can be cyclically conveyed towards the orifice 59xa.

Starting from this condition, and when a voltage corresponding to image information is supplied to the charge injecting electrode 52x, a portion of the inking solution In situated between the charge injecting electrode 52x and the orifice 59xa is expelled outwardly from the nozzle 59x through the orifice 59xa into the air.

A driving circuit 56x is operable to apply a predetermined ink chopper voltage in correspondence with the last stop bit of the one-bit data inputted as the image information as shown in FIGS. 21(a) and 21(c). This ink chopper voltage is selected to have a peak-to-peak value which is about 1.5 times the voltage applied to the coils 57xa. Because of the application of the ink chopper voltage from the driving circuit 56x according to the tenth preferred embodiment of the present invention, no substantial drooping of ink from the orifice 59xa will not occur after a droplet of inking solution has been expelled outwardly through the orifice 56xa.

Figure 23:
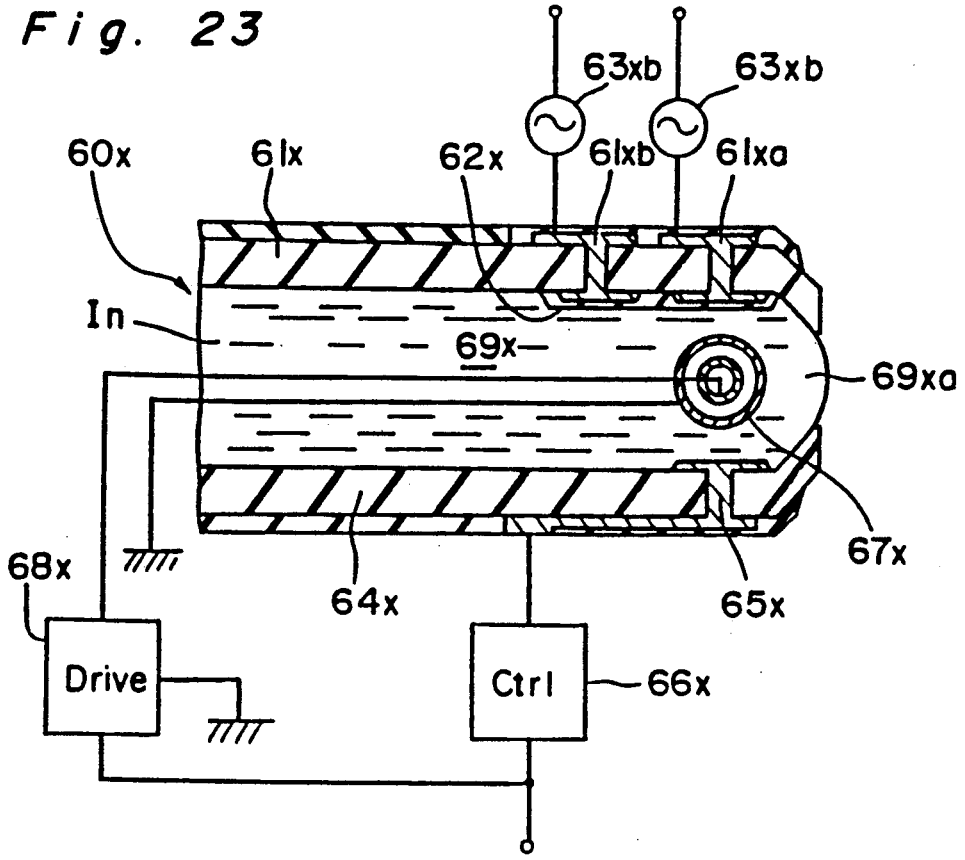
FIGS. 23 to 25 are schematic longitudinal sectional views of the printer head according to eleventh, twelfth and thirteenth preferred embodiments of the present invention, respectively.

Eleventh Embodiment (FIG. 23)

The printer head, generally identified by 60x, according to this eleventh embodiment of the present invention shown in FIG. 23 comprises a nozzle casing including upper and lower panel members 61x and 64x assembled together to define a plurality of nozzles 69x, and a pair of electric field curtain forming electrodes 61xa and 61xb for each nozzle 69x mounted exteriorly on the upper panel member 61x and electrically connected with respective alternating power sources 63xa and 63xb so that the paired electrodes 61xa and 61xb can be supplied with respective voltages which are displaced 90° in phase from each other.

A charge injecting electrode 65x for each nozzle 69x is disposed in a portion of the lower panel member 64x adjacent an orifice 69xa in face-to-face relationship with one of the paired electrodes, that is, the electrode 61xa. A preliminary charge injecting electrode 67x common to all nozzles 69x is also employed in the printer head 60 and is disposed within a corresponding one of nozzles 69x so as to occupy a position intermediate the electrodes 61xa and 65x.

In the printer head 60x according to the eleventh preferred embodiment of the present invention as hereinabove described, a travelling-wave electric field curtain can be formed in the vicinity of and between the electrodes 61xa and 61xb and, therefore, the inking solution In within the nozzle 69x can be conveyed towards the orifice 69xa.

Also, since a voltage can be applied from a driving circuit 68x to the preliminary charge injecting electrode 67x, an electric charge can be preliminarily injected into the inking solution In within the nozzle 69x. The timing at which the electric charge is injected is substantially identical with that employed in the ninth preferred embodiment of the present invention.

While in this condition, and when a voltage corresponding to image information is applied from a print control circuit 66x to the individual electrode 65x, a portion of the inking solution within the nozzle 69x and situated between the preliminary charge injecting electrode 65x and the orifice 69xa can be outwardly expelled through the orifice 69xa.

It is to be noted that, in the illustrated eleventh preferred embodiment of the present invention, the preliminary charge injecting electrode 67x extend through the nozzles 69x having passed through each opposite side walls defining the corresponding nozzle 69x. However, the preliminary charge injecting electrode 67x may be employed for each nozzle 69x.

Figure 24:
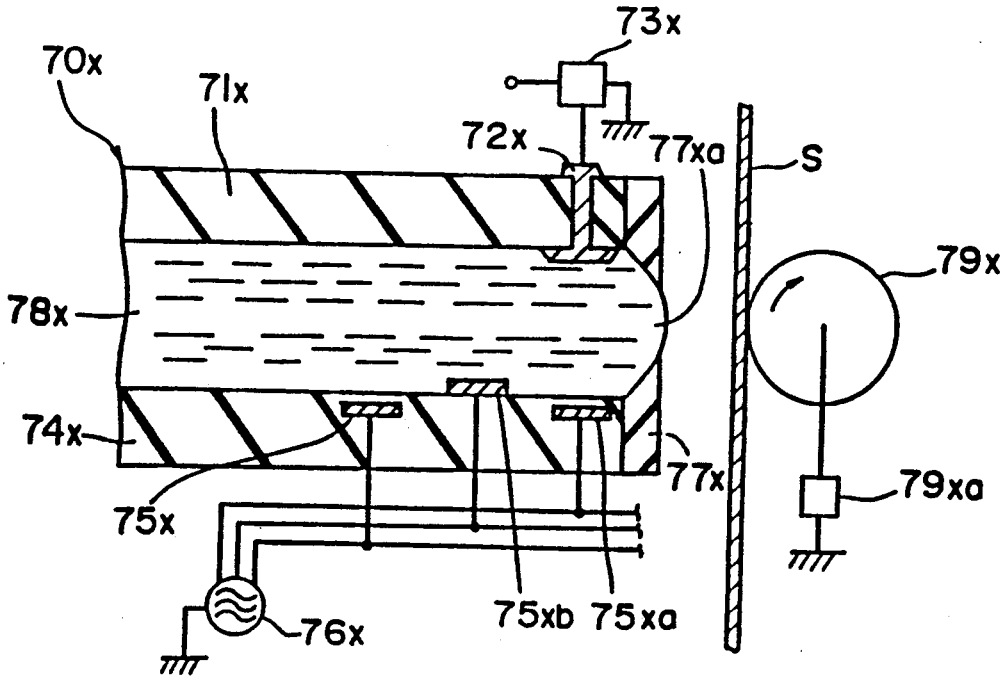

Twelfth Embodiment (FIG. 24)

The printer head according to this twelfth preferred embodiment of the present invention is generally identified by 70x in FIG. 24. As shown therein, the printer head 70x comprises a nozzle casing including upper and lower panel members 71x and 74x assembled together to define a plurality of nozzles 78x, said panel members 71x and 74x having respective side edges to which an orifice plate 77x made of insulating material, for example, liquid crystal polymer, and having orifices 77xa defined therein is fitted with the orifices 77xa aligned with the respective nozzles 78x. Each of the orifices 77xa defined in the orifice plate 77x is of a generally conical or pyramid shape converging in a direction away from the respective nozzle 78x.

The lower panel member 74x has three electric field curtain forming electrodes 75xa, 75xb and 75xc for each nozzle 78x which are connected with an alternating power source 76x. Of these electric field curtain forming electrodes, the front and rear electrodes 75xa and 75xc close to and remote from the associated orifice 77xa, respectively, are embedded in the lower panel member 74x while the intermediate electrode 75xb is exposed into the associated nozzle 78x. On the other hand, the upper panel member 71x has, for each nozzle 78x, one individual electrode 72x carried thereby and partially exposed into the associated nozzle 78x in face-to-face relationship with the front electrode 75xa. This individual electrode 72x is electrically connected with a print control circuit 73x.

Positioned outside the nozzle casing and in front of the orifice plate 77x is a bias platen roller 79x supported for rotation in a direction shown by the arrow about an axis parallel to the direction in which the nozzles 78x are juxtaposed. This bias platen roller 79x is applied a DC bias voltage which is supplied from a DC power source 79xa and which has a polarity different from the polarity of the electric charge built up in the inking solution In.

In the printer head 70x of the above described construction according to the twelfth preferred embodiment of the present invention, when three-phase alternating voltages are applied to the front, intermediate and rear electrodes 75xa, 75xb and 75xc, travelling-wave unequal alternating electric fields oriented towards the respective orifice 77xa can be formed in the vicinity of and between the electrodes 75xa, 75xb and 75xc. Since at this time the intermediate electrode 75xb is in contact with the inking solution In, the electric field formed there is considerably large and, therefore, the force imposed by the electric field so as to convey the inking solution In is correspondingly large. Accordingly, the application of even the slightest voltage to the individual electrode 72x results in that the inking solution In can readily and quickly be expelled outwards. In addition, since a droplet of the inking solution In so expelled outwards through the associated orifice 77xa is electrically attracted by the bias platen roller 79 to which the voltage having a polarity opposite to that of the inking solution In, the ink droplet so expelled can travel a substantially increased distance towards a recording medium S before it is deposited thereon.

In the practice of the twelfth preferred embodiment of the present invention, the interior of a front end of each orifice 77xa may be made of electro-conductive material, in which case an ink chopper voltage has to be applied to the orifice, as is the case with the tenth embodiment of the present invention, thereby to avoid any undesirable drooping of ink outwardly downwardly from the orifice.

Figure 25:
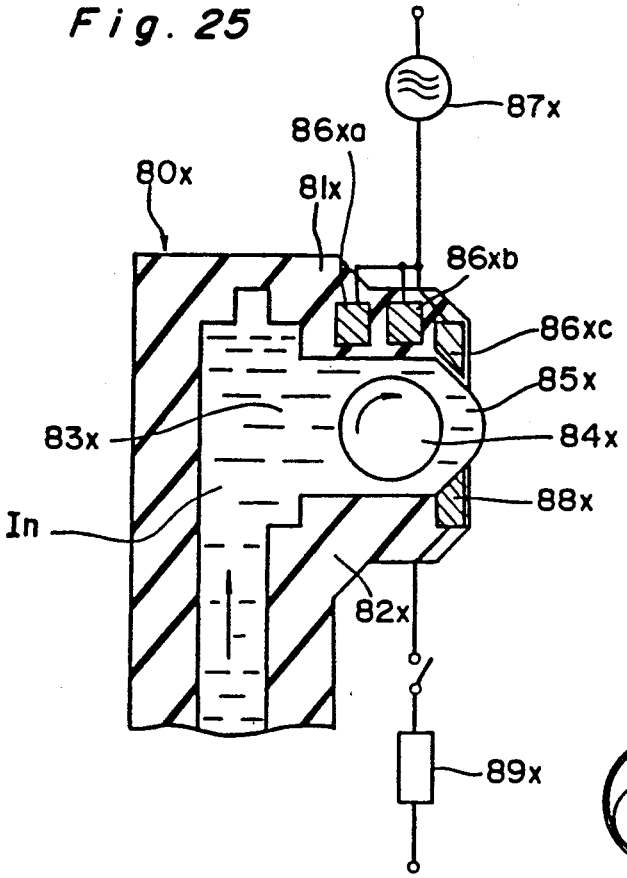
Figure 26:
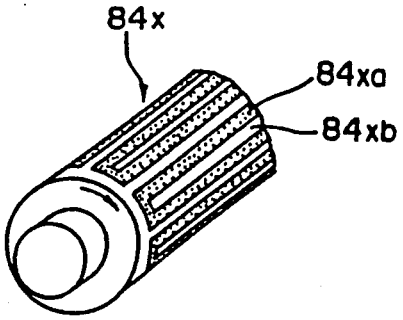
FIGS. 26 and 27 are fragmentary perspective views of different rotors which may be used in the printer head shown in FIG. 25, respectively.
Figure 27:
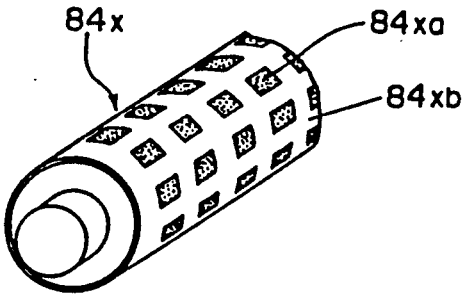

Thirteenth Embodiment (FIGS. 25 to 27)

The printer head according to this thirteenth preferred embodiment of the present invention is shown generally by 80x in FIG. 25. This printer head 80x comprises a nozzle casing including upper and lower panel members 81x and 82x assembled together to define a nozzle 83x having an orifice 85x, and a generally cylindrical rotor 84x extending rotatably within the nozzle 83x at a position adjacent the orifice 85x.

The rotor 84x is made of hydrophobic material, for example, insulating resin, and has its outer peripheral surface formed with hydrophilic patterns 84xa either continued in a direction parallel to the longitudinal axis of the rotor 84x as shown in FIG. 26, or spaced a predetermined distance from each other as shown in FIG. 27. These hydrophilic patterns 84xa are formed by depositing films or foils of, for example, silicon dioxide on the outer peripheral surface of the rotor 84x so as to develop in a direction circumferentially thereof while leaving uncovered stainless steel surface areas each surrounding the hydrophilic patterns 84xa to provide hydrophobic patterns 84xb.

In the vicinity of the orifice 85x delimited by the upper and lower panel members 81x and 82x, there is disposed electric field curtain forming electrodes 86xa, 86xb and 86xc and a charge injecting electrode 88 for forming electric field curtains which form respective travelling-wave unequal electric fields.

Where the hydrophilic patterns 84xa on the outer peripheral surface of the rotor 84x are desired to be employed in the form of discontinued patterns, the hydrophilic patterns 84xa and the individual electrode 88x should have a 1:1 relationship with each other.

In the printer head 80x of the above described construction, by the action of the electric fields formed by the travelling-wave electric field curtain forming electrodes, the inking solution In within the nozzle 83x can be conveyed towards the orifice 85x. At this time, the rotor 84x rotates in the direction shown by the arrow in FIG. 25 and, therefore, the inking solution In is conveyed towards the orifice 85x in the form of a line or dots so defined as a result of movement of the hydrophilic patterns 84xa.

When three-phase alternating voltages are applied from a three-phase alternating power source 87x to the electrodes 86xa, 86xb and 86xc in the upper panel member 81 and a voltage corresponding to image information is applied from a print control circuit 89x to the electrode 88x in the lower panel member 82x, the inking solution In so conveyed in correspondence with the hydrophilic patterns 84xa is electrically charged by the electric field formed between the electrodes 86xc and 88x and is then expelled outwards through the orifice 85x into the air.

The length of time required for the rotor 84x to complete one rotation is so selected as to correspond with the time elapsed before the ink discharge subsequent to the supply of a maximum tone data for each dot. Also, the number of the hydrophilic patterns 84xa as counted in the circumferential direction of the rotor 84x is equal to or greater than the number of the maximum tone data.

According to the thirteenth preferred embodiment of the present invention, the inking solution can be assuredly expelled to the outside through the orifice 85x in response to the charge injection accomplished by the individual electrode 88x, thereby improving a discharge response and a recording speed. Also, the amount of inking solution supplied towards an area confronting the orifice 85x for a unitary time can be stabilized and, therefore, dots formed by depositing ink droplets on a recording medium can exhibit a uniform diameter with substantially increased resolution and reproducibility.

A method for forming the hydrophilic and hydrophobic patterns 84xa and 84xb on the outer peripheral surface of the rotor may not be always limited to that described hereinabove, and they may be formed by a method wherein the outer peripheral surface of the rotor 84x is processed with fluorine resin, such as, for example, polytetrafluoroethylene, to have a hydrophobic property and a portion thereof is subsequently processed by the use of an oxygen plasma process to form the hydrophilic patterns 84xb. Alternatively, a method can also be employed wherein the body of the rotor is made of insulating material and comb-shaped patterns of electroconductive material are subsequently formed on the outer peripheral surface of the rotor 84x in a direction parallel to the longitudinal axis thereof, followed by a uniform coating of insulating layer over the comb-shaped patterns so that, when the alternating voltage is applied to the comb-shaped patterns while the rotor 84x is rotated, the travelling-wave unequal electric fields can be formed to convey the inking solution positively towards the orifice during the rotation of the rotor 84x. With this alternative method, the discharge output of the inking solution can be improved and, even with the high resistance inking solution, it can be expelled to the outside in quick response.

Figure 28:
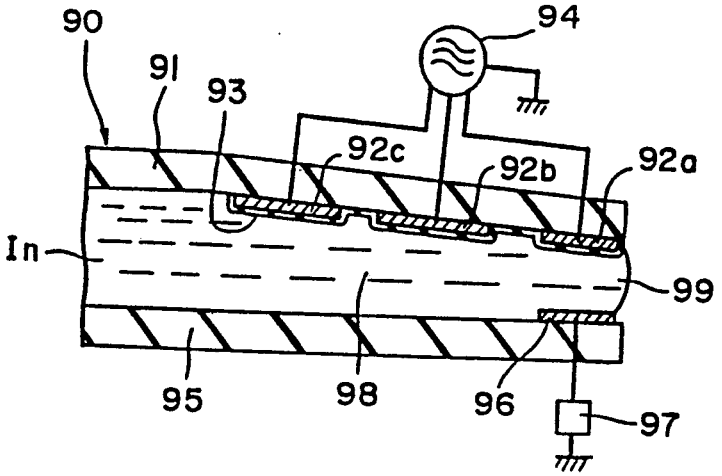
FIG. 28 is a schematic longitudinal sectional view of the printer head according to a fourteenth preferred embodiment of the present invention.
Figure 29:
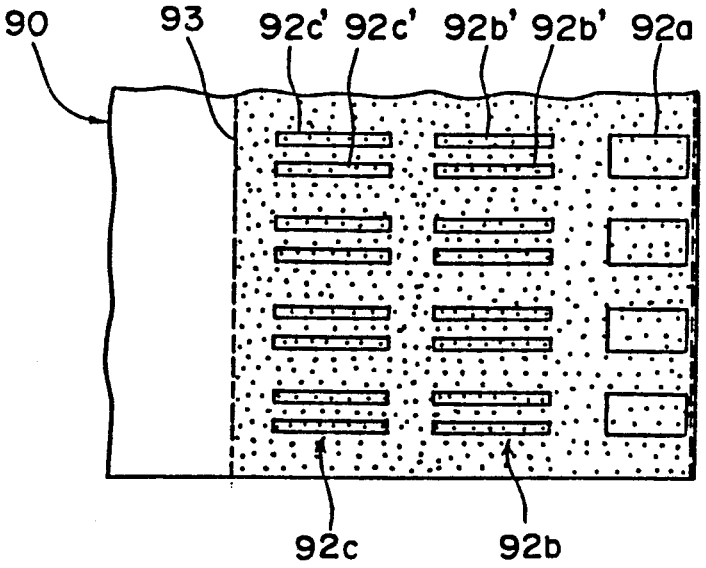
FIG. 29 is a fragmentary bottom plan view of an upper used in the printer head shown in FIG. 28.

Fourteenth Embodiment (FIGS. 28 and 29)

The printer head according to the fourteenth preferred embodiment of the present invention is generally identified by 90 in FIG. 28. This printer head 90 is of a type having an ink chamber in the form of a generally slit-shaped nozzle which is not divided for each individual electrode. Specifically, the printer head 90 comprises a nozzle casing including upper and lower panel members 91 and 95 assembled together so as to define the slit-shaped nozzle 98 having an orifice defined at 99. The upper panel member 91 has electric field curtain forming electrodes 92a, 92b and 92c disposed on a portion of an inner surface thereof adjacent the orifice 99 in this specified order inwardly from the orifice 99 in units of a picture element and partially exposed into the nozzle 98. Those portions of the respective electrodes 92a, 92b and 92c which are exposed into the nozzle 98 are covered by respective insulating linings 93. Of these electric field curtain forming electrodes, each of the rear and intermediate electrodes 92c and 92b with respect to the direction towards the orifice 99 is constituted by a respective pair of small electrode segments 92b' and 92b' or 93b' and 93b' arranged parallel to each other in a direction towards the orifice 99.

The lower panel member 95 has an inner surface provided with individual electrodes 96 disposed in face-to-face relationship with the associated front electric field curtain forming electrodes 92a.

In the printer head 90 of the above described construction according to the fourteenth embodiment of the present invention, when three-phase alternating voltages are applied to the electrodes 92a, 92b and 92c, travelling-wave unequal electric fields are formed in the vicinity of and between these electrodes and, therefore, the inking solution In can be conveyed towards the orifice 99.

At this time, since each of the electrodes 92b and 92c is constituted by the paired small electrode segments 92b' and 92b or 92c' and 92c', the edge density of the electric field can be increased enough to allow the inking solution In to undergo an extensive induced polarization, so that the inking solution In can receive a strong force of repellent relative to rows of the unequal alternating electric fields. Therefore, the application of a voltage to the individual electrode 96 in correspondence with image information results in that the inking solution In can be extensively conveyed towards the orifice 99 and be subsequently expelled outwardly through the orifice 99 after having moved at high speed.

Figure 30:
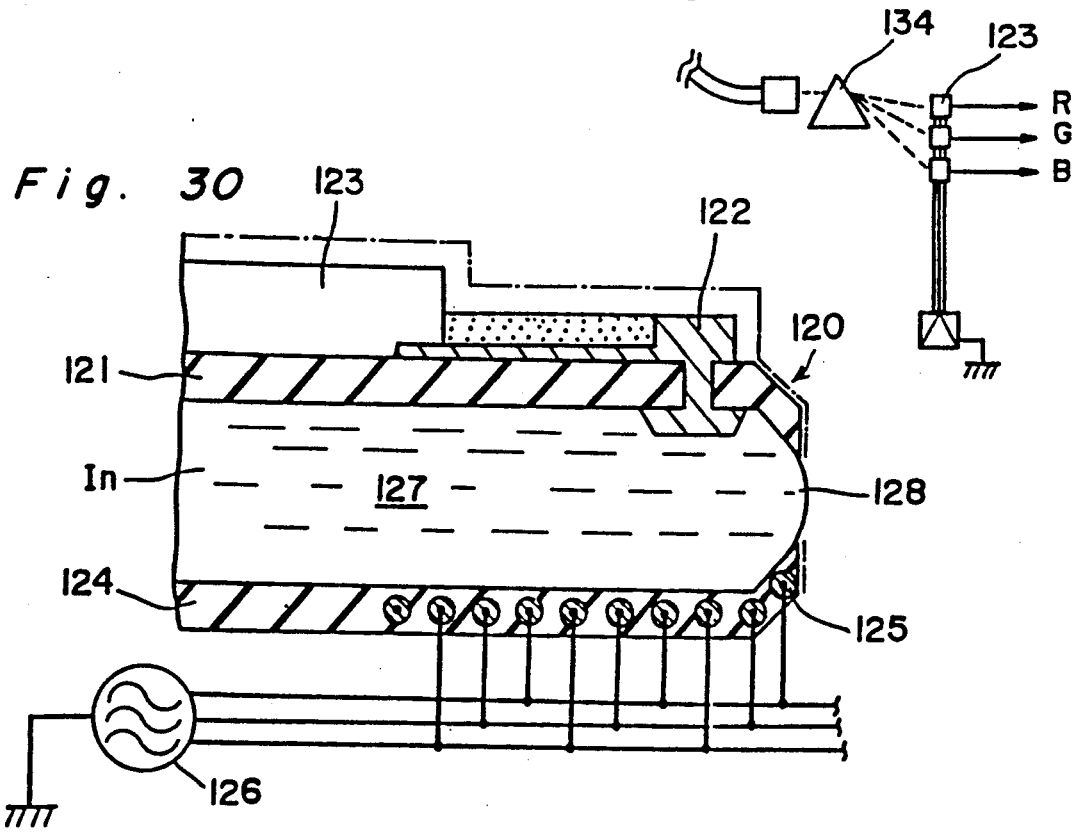
FIG. 30 is a schematic longitudinal sectional view of the printer head according to a fifteenth preferred embodiment of the present invention.

Fifteenth Embodiment (FIG. 30)

The printer head according to the fifteenth preferred embodiment of the present invention is generally shown by 120 in FIG. 30. This printer head 120 comprises a nozzle casing including an upper panel member 121 having charge injecting electrodes 122 mounted therein and electrically connected with analog light information units 123. The nozzle casing also includes a lower panel member 124 having a plurality of pillar electrodes 125 embedded therein so as to extend parallel to a front end face of the printer head, every second pillar electrode 125 being connected to a three-phase alternating power source 126.

In the foregoing printer head 120, when voltages are applied to the electrodes 125 in the lower panel member 124, travelling-wave unequal electric fields can be formed in the vicinity of and between the electrodes 125 and, therefore, the inking solution In within a nozzle 127 defined between the upper and lower panel members 121 and 124 can be cyclically conveyed towards an orifice 128 defined at the front end of the printer head 120.

When the analog light information unit 123 is radiated by rays of light or laser beams reflected from an original, signals of a voltage proportional to the amount of light or laser beams can be outputted to the charge injecting electrodes 122 to allow the latter to inject an electric charge into the inking solution In so that a portion of the inking solution In adjacent each of the charge injecting electrodes 122 and the orifice 128 can be expelled outwards through the orifice 128. It is to be noted that the charge injecting electrodes 122 can be connected to the ground at intervals of a predetermined time by the action of clocks (not shown) to accomplish a pulsating discharge of the inking solution outwardly through the orifice 128.

Figure 31:
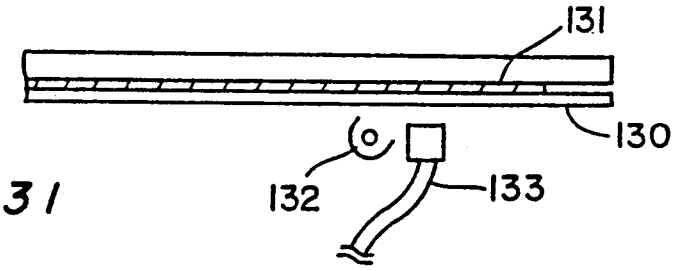
FIG. 31 is a schematic diagram showing a method of inputting a light signal to an analog light information unit.

The radiation of the analog light information unit 123 referred to above can be carried in the following manner in the case of a copying machine. As shown in FIG. 31, rays of light emitted from a light source 132 to illuminate a multicolored original 131 placed on a document support glass 130 are, after having been reflected therefrom, transmitted through an optical fiber bundle 133 to a prism 134 and are then divided by the prism 134 into red, green and blue light components. The red, green and blue light components emerging from the prism 134 are respectively radiated to the respective analog light information units 123 of the printer head accommodating red-, green- and blue-colored inking solutions.

Figure 32:
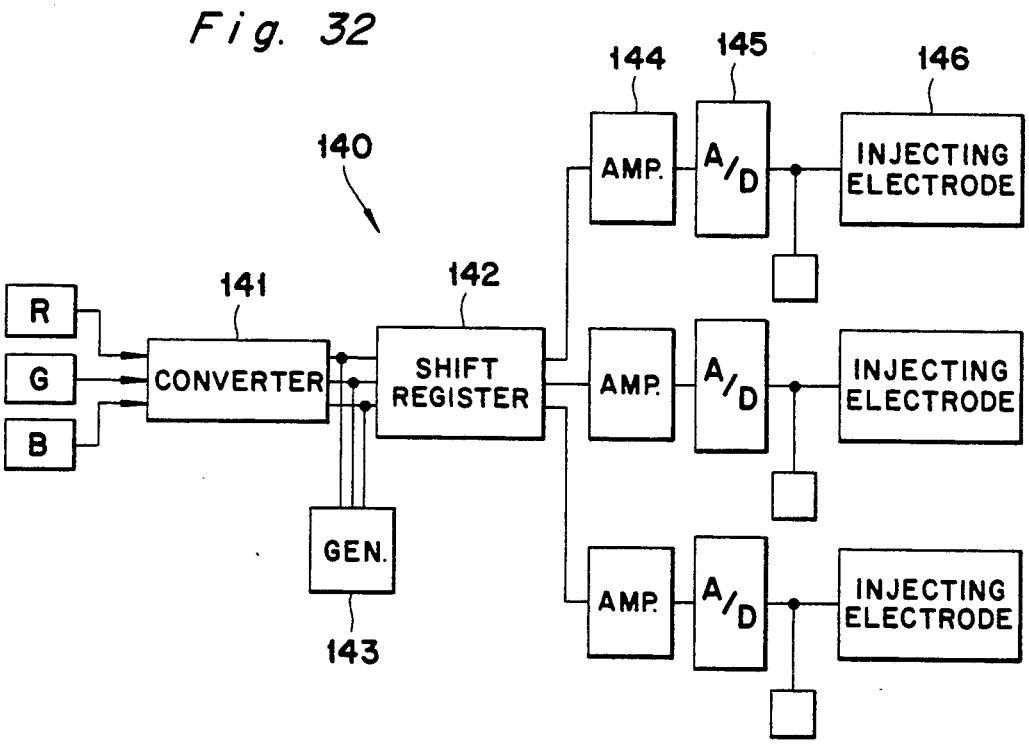
FIG. 32 is a block circuit diagram showing the analog light information unit.
Figure 35:
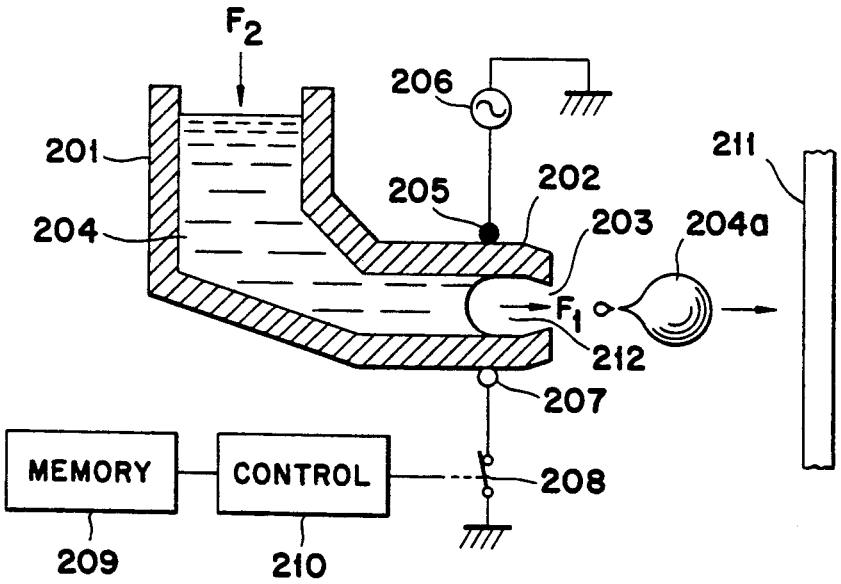

A control circuit used in each of the analog light information unit 123 is shown in FIG. 32 and is generally identified by 140.

Referring now to FIG. 32, the control circuit 140 comprises a photoelectric converter 141 including three color sensors to which the red, green and blue light components R, G and B emerging from the prism 134 are respectively radiated. Each of the color sensors provides to a shift register 142 a voltage signal proportional to the amount of light received thereby. It is to be noted that the output to the shift register 142 is reset at intervals of a predetermined time by a clock generator 143 and, therefore, an image signal corresponding to one line can be retained in the shift register 142.

The image signals retained in the shift register 142 as hereinabove described are, after having been amplified by respective amplifiers 144 and then digitalized by respective analog-to-digital converters 145, outputted to charge injecting individual electrodes 146. These electrodes 146 are in conduction with the charge injecting electrodes 122 to inject into the inking solution the electric charge corresponding to the image signal.

Inking Solution

Finally, the inking solution which can be utilized in the practice of the present invention will now be discussed. The inking solution utilizable in the practice of the present invention is available in first and second types. The first type is that pigment (inking pigment or inking material) dispersed in a liquid medium moves with the liquid medium using as a carrier, and the second type is that, while a coloring agent is dissolved in a liquid medium, the resultant solution as a whole behaves as an inking solution. The first type may be regarded a two-component type because the liquid carrier is used to electrically charge and transport the pigment, whereas the second type may be regarded a onecomponent type because the inking solution is transported with no liquid carrier employed.

The inking solution utilizable in the practice of the present invention may be either water-based having a volume resistance not higher than $10^7$ to $10^8$ Ω.cm, or oil-based having a volume resistance not lower than $10^7$ to $10^8$ Ω.cm.

The details of the two-component inking solution will first be described.

In general, the inking solution tends to exhibit a high resistance since the pigment will not become water-soluble unless they are surface-treated to have an aqueous group.

The liquid carrier used in the high resistance inking solution utilizable in the present invention must satisfy the following requirements and, therefore, the use of an isoparaffin type solvent having a boiling point within the range of 120° to 200° C. is desirable for the liquid carrier.

(1) The liquid carrier must have an electric resistance not lower than $10^7$ to $10^8$ Ω.cm, in order to avoid any possible leakage of the electric charge.

(2) The liquid carrier must have a chemically inactive property, in order to avoid any possible undesirable attack to ink grooves, material forming the orifice and/or material forming the electrodes.

(3) The liquid carrier must not have a toxicity, a flammability and an offensive odor.

The inking solution is of a composition containing the above described liquid carrier in which pigment particles of 0.2 to 1.0μ in particle size are dispersed in colloidal state.

Where a black-colored pigment is to be employed, it may be carbon black. As is well known to those skilled in the art, depending on the method of preparing the carbon black, the carbon black is available in two types, channel black and furnace black. The channel black is suitable as an acidic, electrically negative pigment, whereas the furnace black is suitable as a basic, electrically positive pigment. It is, however, to be noted that the furnace black may be used as a substitute for the channel black if the furnace black is oxidized with nitric acid or the like to have an increased content of both of volatile component and oxygen.

For coloring pigment utilizable in the inking solution used in the practice of the present invention, the following composition can be employed.

Red: Tambustrinic acid molybdic acid lake of a mixture of indolenine and xanthene pigments, and a mixed lake of cationic azo dystuff and xanthene dystuff.

Magenta: Metal salts of acidic azo dystuff.

Orange: Copolymers of azo dystuff containing aminotriazophosphoric group.

Yellow: Guanidium salts of azo dystuff, precipitates of yellow azo dystuff xanthene type or indolenine type dystuff and molybdotungstrinic acid.

Blue: Guanidium salts, and a mixture of anthracene and phthalocyanine.

Violet: Metal complex pigment of formazan derivatives.

Since the above listed pigments are inorganic material, they cannot be easily dispersed into the liquid carrier which is organic material. Because of this, it is preferred that, in order to improve the dispersibility, a coupling agent is either added to surfaces of particles of the pigment or dispersed in the liquid carrier.

The coupling agent may be preferably employed in the form of organic material containing either a polymer chain A having a strong affinity to the pigment particles or polymer chain B having no substantial affinity with the pigment particles, but having a strong affinity with the liquid carrier.

Example of the polymer chain A includes methacrylate methyl or the like, and example of the polymer chain B include such substances as having the following chains. —COOH,

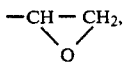

and $—N(CH_3)_2$.

For controlling the electric chargeability of the pigment particles, any one of the following methods can be contemplated.

(I) To add one of the following metal salts of soluble organic acid to the liquid carrier:

metal salts of carbonic acids such as naphthenic acid, linolenic acid, oleic acid, octyl acid, palmitic acid and stearic acid, and metal salts of $C_{12-16}$ alkylsulfuric acid and $C_{3-18}$ alkyl phosphoric acid. Metal may include tin, manganese, cobalt, calcium, aluminum, lead, titanium or the like.

(II) To add a liquid carrier having a different dielectric constant:

For example, if a liquid medium such as butanol or isopropanol effective to increase the dielectric constant is added to the liquid carrier, the negative polarity of a developing agent increases, but if low-class fatty carbon or hydrogen is added to the liquid carrier, the electroconductivity tends to be lowered with the positive polarity increased.

(III) To add a compound having a polar group to either the liquid carrier or the pigment particles.

By way of example, the pigment used is added with a polymer having a polar group apt to be absorbed by or polymerized with particles of the pigment. Example of the polar group includes: $—NH_2$, $—CONH_2$, —CN, —OH, $—N(CH_3)_2$, —COOH,

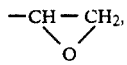

—Cl, $—NO_2$.

(IV) To mix and add the pigment having a high electric charge:

By way of example, phthalocyanine having no metal is added.

(V) To add other surface active agent such as, for example, 4-class ammonium or polyethylene glycol having a $NH_2$ group.

Hereinafter, the one-component inking solution refered to hereinbefore will be discussed.

The one-component inking solution utilizable in the practice of the present invention may be either water-based or oil-based, however, the aqueous inking solution in which pigments are dissolved in an aqueous solvent is preferred. The one-component inking solution utilizable may have one of the following compositions.

Water-soluble Inking Solution I:

| Composition | Amount (wt %) |
|---|---|
| Demineralized water | 80.45 |
| Polyethylene glycol | 4.60 |

-continued

Water-soluble Inking Solution I:

| Composition | Amount (wt %) |
|---|---|
| Direct black GW (dyestuff) | 2.25 |
| Monoethanolamine | 6.05 |
| Methoxytriglycol | 4.55 |
| N-methylpyrrolidone | 2.00 |
| Dioxane | 0.2 |

The inking solution of the composition I above has a volume resistance of $7.2\times10^3$ Ω.cm.

Inking Solution II:

| Composition | Amount (wt %) |
|---|---|
| Demineralized water | 50.00 |
| Glycerin | 30.65 |
| Direct black GW (dystuff) | 1.50 |
| Cabamine Black ESA (dyestuff) | 0.75 |
| Polyethylene glycol | 4.50 |
| Methoxytriglycol | 4.50 |
| Polyvinyl butyral | 8.00 |
| Dioxiane | 0.10 |

The inking solution of the composition I above has a volume resistance of $4.3\times10^4$ Ω.cm.

Inking Solution III:

| Composition | Amount (wt %) |
|---|---|
| Polyethylene glycol | 70.0 |
| Cyclohexane | 22.5 |
| Methoxytriglycol | — |
| Demineralized water | 1.5 |
| Direct black GW (dyestuff) | 0.7 |
| Cabamine Black ESA (dyestuff) | 3.7 |
| Dioxiane | 0.1 |
| Ammonium carbamate | 1.5 |

The inking solution of the composition I above has a volume resistance of $1.1\times10^7$ Ω.cm.

Inking Solution IV:

| Composition | Amount (wt %) |
|---|---|
| Polyethylene glycol | 75.0 |
| Cyclohexane | 18.0 |
| Methoxytriglycol | 1.5 |
| Demineralized water | — |
| Direct black GW (dyestuff) | 0.7 |
| Cabamine Black ESA (dyestuff) | 3.7 |
| Dioxiane | 1.0 |
| Ammonium carbamate | 1.0 |

The inking solution of the composition I above has a volume resistance of $5.3\times10^8$ Ω.cm.

Although the present invention has been described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

We claim:

1. An inkjet printer which comprises:

a nozzle for containing ink and having an exit opening through which the ink may be spattered;

means for forming an unequal alternating electric field oriented towards the exit opening at a constant level;

means controlled separately from the electric field forming means for injecting an electric charge into ink situated within the unequal alternating electric field; and means for controlling the charge injecting means to vary an amount of electric charge to be injected into the ink in accordance with an image forming signal while said electric field forming means maintains said electric field at a constant level.

2. The inkjet printer as claimed in claim 1, wherein said electric field forming means comprises at least one pair of electrodes disposed in a vicinity of the exit opening, and an electric power source for applying an alternating voltage between the electrodes.

3. The inkjet printer as claimed in claim 1, wherein said electric field forming means comprises a generally coil-shaped electrode disposed circumferentially around the nozzle and an electric power source for applying an alternating voltage to the electrode.

4. The inkjet printer as claimed in claim 1, wherein said charge injecting means comprises an electrode held in contact with the ink within the nozzle and an electric power source for applying a voltage to the electrode.

5. The inkjet printer as claimed in claim 1, wherein said charge injecting means comprises a charge injecting electrode disposed so as to contact the ink within the nozzle, a counter electrode disposed interiorly in the nozzle in face-to-face relationship with said charge injecting electrode, and an electric power source for applying a voltage between the charge injecting electrode and the counter electrode whereby, when the voltage from the power source is applied between the charge injecting electrode and the counter electrode, an electric field is produced between the charge injecting electrode and the counter electrode for injecting an electric charge into the ink.

6. The inkjet printer as claimed in claim 1, wherein said charge injecting means comprises a pair of electrodes juxtaposed with respect to each other and held in contact with the ink within the nozzle, and means for applying a voltage between the electrodes.

7. The inkjet printer as claimed in claim 1, wherein said nozzle comprises an ink supply unit made of material having an affinity with the ink and the exit opening made of material having no affinity with the ink.

8. The inkjet printer as claimed in claim 1, wherein said nozzle has a plurality of nozzle openings juxtaposed in a line.

9. The inkjet printer as claimed in claim 1, further comprising a roller supported for rotation within the nozzle for mixing the ink.

10. The inkjet printer as claimed in claim 9, wherein said roller is applied a direct current bias voltage for preliminarily electrically charging the ink.

11. The inkjet printer as claimed in claim 1, further comprising ink which is an organic liquid carrier having a resistance within a range of $10^7$ to $10^8$ Ω.cm and pigment particles which are electrically charged.

12. The inkjet printer as claimed in claim 1, further comprising ink which is an aqueous inking solution having pigment dissolved in an aqueous solvent.

13. An inkjet printer which comprises:

a nozzle for containing ink and having an exit opening through which the ink may be spattered in a spattering direction;

means for forming a travelling-wave unequal alternating electric field travelling towards the exit opening and which runs substantially parallel to said spattering direction of the ink;

means, controlled separately from said electric field forming means, for injecting an electric charge into a portion of the ink situated within the travelling-wave unequal alternating electric field; and means operable in response to image information for controlling the charge injecting means to vary an amount of electric charge to be injected into the ink in accordance with an image forming signal.

14. The inkjet printer as claimed in claim 13, wherein said travelling-wave electric field forming means comprises a plurality of electrodes disposed within the nozzle, and an electric power source for applying a plurality of single-phase alternating voltages, different in phase from each other, to each neighboring electrode.

15. The inkjet printer as claimed in claim 14, wherein said electric power source is operable to apply a three-phase alternating voltage to each neighboring electrode.

16. The inkjet printer as claimed in claim 13, wherein said travelling-wave electric field forming means comprises a plurality of generally coil-shaped electrodes, and an electric power source for applying a plurality of single-phase alternating voltages, different in phase from each other, to each neighboring coil-shaped electrode.

17. The inkjet printer as claimed in claim 13, wherein said charge injecting means comprises a first electrode and a second electrode, and a first electric power source and a second electric power source for applying direct current voltages to the first electrode and second electrode, respectively, said first electrode being positioned downstream of the second electrode with respect to a direction of travel of the travelling-wave electric field.

18. The inkjet printer as claimed in claim 17, wherein said image control means responds to an image signal such that, after a direct current voltage has been applied from the first electric power source to the first electrode, the direct current voltage is applied from the second electric power source to the second electrode to inject the electric charge into the ink.

19. The inkjet printer as claimed in claim 14, wherein said charge injecting means comprises at least one electrode located opposite an electrode of said travelling-wave electric field forming means closest to said nozzle.

20. An inkjet printer as claimed in claim 19 wherein each time said charge injecting means injects a charge into the ink, an electric field is generated between said at least one electrode of the charge injecting means and the electrode of the travelling-wave electric field forming means closest to the nozzle, whereby a droplet of ink is expelled from said nozzle.

21. An inkjet printer as claimed in claim 13 wherein said nozzle comprises an upper panel member and a lower panel member, said lower panel member having a plurality of grooves formed therein, and wherein said charge injecting means comprises a plurality of electrodes, each of said electrodes disposed in a respective one of said grooves.

22. An inkjet printer as claimed in claim 13 wherein said travelling-wave electric field forming means applies a predetermined force to the ink in a direction of the nozzle opening and wherein said predetermined force is such that a magnitude of all forces acting on the ink in the nozzle direction is equal to a magnitude of a surface tension force acting on the ink opposite the nozzle direction prior to the injection of any charge into the ink.

* * * * *